US006595625B2

(12) United States Patent
Sugama et al.

(10) Patent No.: US 6,595,625 B2
(45) **Date of Patent: *Jul. 22, 2003**

(54) LIQUID DISCHARGING METHOD ACCOMPANIED BY THE DISPLACEMENT OF A MOVABLE MEMBER, A LIQUID JET HEAD FOR IMPLEMENTING SUCH METHOD, AND A LIQUID JET APPARATUS FOR THE IMPLEMENTATION THEREOF

(75) Inventors: Sadayuki Sugama, Tsukuba (JP); Akira Asai, Atsugi (JP); Hiroyuki Ishinaga, Tokyo (JP); Toshio Kashino, Chigasaki (JP); Kiyomitsu Kudo, Yokohama (JP); Hiroyuki Sugiyama, Sagamihara (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/889,184

(22) Filed: Jul. 7, 1997

(65) Prior Publication Data

US 2002/0021335 A1 Feb. 21, 2002

(30) Foreign Application Priority Data

Jul. 12, 1996 (JP) ..... 8-183748

(51) Int. Cl.[7] ..... B41J 2/05
(52) U.S. Cl. ..... 347/65
(58) Field of Search ..... 347/65, 63

(56) References Cited

U.S. PATENT DOCUMENTS 4,330,787 A 5/1982 Sato et al. ..... 347/63
4,459,600 A 7/1984 Sato et al.
4,480,259 A 10/1984 Kruger et al. ..... 347/63
4,509,063 A 4/1985 Sugitani et al.
4,558,333 A 12/1985 Sugitani et al.
4,568,953 A 2/1986 Aoki et al.
4,611,219 A 9/1986 Sugitani et al.

(List continued on next page.)

FOREIGN PATENT DOCUMENTS

AU 40922/96 A 8/1996
AU 40923/96 A 8/1996

(List continued on next page.)

*Primary Examiner*—Hezron Williams
(74) *Attorney, Agent, or Firm*—Fitzpatrick, Cella, Harper & Scinto

(57) ABSTRACT

A liquid discharging method comprises the step of displacing the free end of the movable member following the creation of air bubble in the air bubble generating area. For this method, the fulcrum of the movable member is positioned on the side different from liquid discharging side with respect to the displacement area for the free end of the movable member to be displaceable, and at the same time, the free end thereof is arranged to face the effective bubbling area positioned on the downstream side of the central portion of the length of the effective bubbling area that forms the bubble generating area in the direction of the movable member from the fulcrum to the free end thereof, and a part of the effective bubbling area positioned to face the free end of the movable member on the downstream side of the effective bubbling area is arranged to face the displacement area directly. Thus, the initiation of the displacement of the free end of the movable member is effectuated quickly and reliably, and the pressure exerted by the air bubble creation is led to the discharge port side and the fulcrum side of the movable member sufficiently at the time of bubbling, and the development of air bubble that follows is directed to the discharge port side more reliably and efficiently.

14 Claims, 14 Drawing Sheets

U.S. PATENT DOCUMENTS

| | | | | |
|---|---|---|---|---|
| 4,698,645 | A | 10/1987 | Inamoto | |
| 4,719,478 | A | 1/1988 | Tachihara et al. | |
| 4,723,129 | A | 2/1988 | Endo et al. | |
| 4,723,136 | A | 2/1988 | Suzumura | |
| 4,740,796 | A | 4/1988 | Endo et al. | |
| 4,831,391 | A | 5/1989 | Asai | |
| 4,849,774 | A | 7/1989 | Endo et al. | |
| 5,122,814 | A | 6/1992 | Endo et al. | |
| 5,159,349 | A | 10/1992 | Endo et al. | |
| 5,182,577 | A | 1/1993 | Ishinaga et al. | |
| 5,278,585 | A | 1/1994 | Karz et al. | 347/65 |
| 5,296,875 | A | 3/1994 | Suda | |
| 5,389,957 | A | 2/1995 | Kimura et al. | |
| 5,485,184 | A | 1/1996 | Nakagomi et al. | |
| 5,521,621 | A | 5/1996 | Endo et al. | |
| 5,821,962 | A | * 10/1998 | Kudo | 347/65 |

FOREIGN PATENT DOCUMENTS

| | | | | |
|---|---|---|---|---|
| AU | 40925/96 | A | 8/1996 | |
| AU | 50663/96 | A | 10/1996 | |
| AU | 50665/96 | A | 10/1996 | |
| AU | 50669/96 | A | 10/1996 | |
| AU | 50894/96 | A | 11/1996 | |
| AU | 50896/96 | A | 11/1996 | |
| AU | 54643/96 | A | 1/1997 | |
| EP | 0436047 | | 7/1991 | B41J/2/055 |
| EP | 0721842 | A2 | 7/1996 | |
| EP | 0813967 | A2 | 12/1997 | |
| EP | 0819529 | A2 | 1/1998 | |
| JP | 55081172 | | 6/1980 | |
| JP | 61069467 | | 4/1986 | B41J/3/04 |
| JP | 61110557 | | 5/1986 | |
| JP | 61059914 | | 12/1986 | |
| JP | 62048585 | | 3/1987 | |
| JP | 62156969 | | 7/1987 | |
| JP | 63197652 | | 8/1988 | |
| JP | 63199972 | | 8/1988 | |
| JP | 03081155 | | 4/1991 | |
| JP | 05124189 | | 9/1993 | B41J/2/05 |
| JP | 06087214 | | 3/1994 | |

* cited by examiner

LIQUID DISCHARGING METHOD ACCOMPANIED BY THE DISPLACEMENT OF A MOVABLE MEMBER, A LIQUID JET HEAD FOR IMPLEMENTING SUCH METHOD, AND A LIQUID JET APPARATUS FOR THE IMPLEMENTATION THEREOF

BACKGROUND OF THE INVENTION

1. Field of the Invention

The present invention relates to a liquid discharging method, a liquid jet head, and a liquid jet apparatus for discharging a desired liquid by the creation of air bubbles brought about by causing thermal energy to act upon liquid. More particularly, the invention relates to a liquid discharging method, a liquid jet head, and a liquid jet apparatus provided with a movable member to be displaced by the utilization of the air bubble creation.

The present invention is also applicable to a printer for recording on a recording medium, such as paper, thread, fabric, cloth, leather, plastic, glass, wood, or ceramics, and to a copying machine, a facsimile equipment provided with communication systems, a word processor and other apparatuses having a printing unit therefor. Further, the present invention is applicable to a recording system for industrial use, which is complexly combined with various processing apparatuses.

Here, the term "recording" in the description of the present invention means not only the provision of images having characters, graphics, or other meaningful representation, but only the provision of those images that do not present any particular meaning, such as patterns.

2. Related Background Art

There has been known the so-called bubble jet recording method, which is an ink jet recording method whereby to form images on a recording medium by discharging ink from discharge ports using acting force exerted by the change of states of ink brought about by the abrupt voluminal changes (creation of air bubbles) when thermal energy or the like is applied to ink in accordance with recording signals. For the recording apparatus that uses the bubble jet recording method, it is generally practiced to provide, as disclosed in the specifications of U.S. Pat. No. 4,723,129 and others, the discharge ports that discharge ink, the ink paths conductively connected to the discharge ports, and electrothermal transducing elements arranged in each of the ink paths as means for generating energy for discharging ink.

In accordance with such recording method, it is possible to record high quality images at high speeds with a lesser amount of noises. At the same time, the head that executes this recording method makes it possible to arrange the discharge ports for discharging ink in high density, with the excellent advantage, among many others, that images are made recordable in high resolution, and that color images are easily obtainable by use of a smaller apparatus. In recent years, therefore, the bubble jet recording method is widely adopted for many kinds of office equipment, such as a printer, a copying machine, a facsimile equipment. Further, this recording method is utilized even for industrial systems, such as a textile printing, among others.

Along the wider utilization of bubble jet technologies and techniques for various products in many different fields, there have been increasingly more demands in recent years as given below.

For example, as to the demand on the improvement of energy efficiency, the adjustment of the thickness of protection film has been studied to optimize the performance of heat generating elements. A study of the kind has produced effects on the enhancement of transfer efficiency of generated heat to liquids.

Also, in order to obtain high quality images, there has been proposed a driving condition under which a liquid discharging method or the like is arranged to be able to execute good ink discharges at higher ink discharging speeds with more stabilized creation of air bubbles. Also, from the viewpoint of a high-speed recording, there has been proposed the improved configuration of liquid flow paths that makes it possible to obtain a liquid jet head capable of refilling liquid to the liquid flow paths at higher speeds in order to make up the liquid that has been discharged.

Of the various configurations of liquid flow paths thus proposed, the structure of liquid flow paths and a method for manufacturing heads, which are disclosed in the specification of Japanese Patent Application Laid-open No. 63-199972, are the inventions devised with attention given to the back waves (the pressure directed opposite to the direction toward the discharge ports, that is, pressure exerted in the direction toward the liquid chamber). The back waves are known as energy loss because such energy is not exerted in the discharging direction.

However, with respect to the structure as disclosed, it is clearly understandable that the partial suppression of the back waves is not practical for liquid discharge when studies are made on the condition under which the air bubbles are created in the liquid flow path that retains the discharging liquid in it.

Fundamentally, the back waves themselves are not related directly with discharging as described above. Of the pressures exerted by the air bubble, those directly related with discharging have already acted upon liquid so that the liquid is in the state of being discharged from the liquid flow path the moment the back waves are generated in the flow path. Therefore, even if the back waves are suppressed, it is clear that no significant influence is exerted on the liquid discharge, not to mention the partial suppression as described earlier.

On the other hand, for the bubble jet recording method, each of the heat generating elements repeats heating, while being in contact with ink. As a result, deposit is accumulated on the surface of each heat generating element due to burning of ink. Depending on the kinds of ink, such deposit is made in a considerable quantity, and results in the instabilized creation of air bubbles, hence making it difficult to perform ink discharges in good condition. Also, it is desired to provide a method for performing discharges in good condition without changing the quality of discharging liquid even when the liquid used has the nature such as to be easily deteriorated by the heat application or such as to make sufficient bubbling difficult.

Here, with this in view, there has been proposed a method for discharging liquid by transferring pressure exerted by bubbling to discharging liquid, while arranging means for separating the liquid used to create air bubbles by the application of head (bubbling liquid) and the liquid for use of discharges (discharging liquid) as different liquids, such as disclosed in the specifications of Japanese Patent Application Laid-Open No. 61-69467, Japanese Patent Application Laid-Open No. 55-81172, U.S. Pat. No. 4,480,259, among some others. In accordance with these disclosures, the structure is arranged to completely separate ink serving as discharging liquid, and bubbling liquid by use of silicon rubber or some other flexible film so as not to allow the discharging liquid to be directly in contact with the heat generating elements, and at the same time, to transfer pressure exerted by bubbling of the bubbling liquid to the discharging liquid by means of the deformation of the flexible film. With a structure of the kind, it is attained to prevent the deposit from being accumulated on the surface of each heat generating element, the improvement of selection range of discharging liquids, or the like.

However, the structure that completely separates discharging liquid and bubbling liquid as described above is the one whereby to transfer pressure exerted at the time of bubbling to discharging liquid by means of the deformation of the flexible film brought about by its expansion and contraction. Therefore, the pressure exerted by the deforming thereof is absorbed by the flexible film to a considerable extent. Also, the amount of deformation of the flexible film is not large. As a result, although it is possible to obtain effect that discharging liquid and bubbling liquid are made separable, there is a fear that energy efficiency and discharging power are lowered after all.

SUMMARY OF THE INVENTION

The applicant hereof has filed an application for a patent of such an extremely high technical standard as compared with the conventional technical level that the developing component of each air bubble on the downstream side is positively transferred to the free end side of each movable member with a view to enhancing the conventionally fundamental discharging characteristics of the liquid discharging method that form air bubbles (particularly, the air bubbles following film boiling) basically in each of the liquid flow path to such a high standard that has been expected in the conventional art. The invention has been designed with the thought that the development component of the air bubble on the downstream side should be taken into account for a remarkable enhancement of the discharging characteristics in consideration of the behavior of energy given to the discharge amount by the air bubbles themselves, and that the development component of each air bubble should be made changeable in the discharging direction effectively.

The present invention is an invention based on a new knowledge for the provision of a new discharging method and discharging principle, which make it possible to improve the discharging principle and the functional effects of the epoch-making previous invention still more.

In other words, the new knowledge means the acquirement of a technique that makes it possible to improve the displacement environment still more by the phenomenal analysis with respect to the free end of each movable member before its displacement begins, and then, to implement further development or induction of each air bubble and the transfer of liquid, which are synthetically formed, toward the discharge port side, including the formation of structure, which is capable of effectively utilizing the power obtainable from each of the air bubble generating areas as a desired objective.

The present invention is designed by giving attention to the physical state of the relationship between the movable members and the air bubbles, which includes inventions with respect to the new discharging principle, structural features, and many other aspects.

The major objectives of the invention is given below. It is a first object thereof to provide an extremely new liquid discharging principle by means of a fundamental control of the created air bubbles.

It is a second object of the invention to provide a liquid discharging method, a liquid jet head, and others capable of discharging liquid in excellent condition by improving the pressure distribution in liquid to be exerted at the time of bubbling for the further enhancement of discharging efficiency, and by improving the displacement environment of the free end of each movable member for directing each of the air bubbles toward each of the discharge ports.

It is a third object of the invention to provide a liquid discharging method, a liquid jet head, and others capable of enhancing the printing speed or the like by suppressing the action of the inertial force caused by the back waves in the direction opposite to the direction of liquid supply, and at the same time, by reducing the regressive amount of meniscus by use of the valve mechanism of each of the movable member for the enhancement of refilling frequency.

In order to achieve the objects described above, the present invention relates to a liquid discharging method comprising the step of displacing the free end of each movable member following the creation of each air bubble in the air bubble generating area, the fulcrum of the movable member being positioned on the side different from liquid discharging side with respect to the displacement area for the free end of the movable member to be displaceable, at the same time, the free end thereof being arranged to face the effective bubbling area positioned on the downstream side of the central portion of the length of the effective bubbling area forming the air bubble generating area in the direction of the movable member from the fulcrum to the free end thereof, and a part of the effective bubbling area positioned to face the free end thereof on the downstream side of the effective bubbling area being arranged to face the displacement area directly.

Also, the part of the effective bubbling area facing the displacement area directly is arranged to include the most downstream side with respect to the effective bubbling area in the aforesaid direction.

Also, the part of the effective bubbling area facing the displacement area directly is a range of 5 $\mu$m or more as the range with respect to the aforesaid direction.

Also, the inclination of pressure in the vicinity of the displacement area of the free end of the movable member is intensified by means of a structure for reflecting or inducing the acoustic waves generated at the time of bubbling in the effective bubbling area.

Also, the air bubbles are created by means of film boiling phenomenon in the effective bubbling area of each heat generating elements.

Also, the present invention relates to a liquid jet head for displacing the movable member, each having the free end, together with air bubble created in the air bubble generating area by means of each of the electrothermal transducing elements, the fulcrum of the movable member being positioned on the side different from liquid discharging side with respect to the displacement area for the free end of the movable member to be displaceable, at the same time, the free end thereof being arranged to face the effective bubbling area positioned on the downstream side of the central portion of the length of the effective bubbling area forming the air bubble generating area in the direction of the movable member from the fulcrum to the free end thereof, and a part of the effective bubbling area positioned to face the free end thereof on the downstream side of the effective bubbling area being arranged to face the displacement area directly.

Also, the part of the effective bubbling area facing the displacement area directly is arranged to include the most downstream side with respect to the effective bubbling area in the aforesaid direction.

Also, the part of the effective bubbling area facing the displacement area directly is a range of 5 $\mu$m or more as the range with respect to the aforesaid direction.

Also, the inclination of pressure in the vicinity of the displacement area of the free end of the movable member is intensified by means of a structure for reflecting or inducing the acoustic waves generated at the time of bubbling in the effective bubbling area.

Also, the air bubbles are created by means of film boiling phenomenon in the effective bubbling area of each heat generating elements.

Also, the present invention relates to a liquid jet apparatus using the aforesaid liquid jet head, which is provided with a structure capable of supplying equal liquid to the displacement area and the air bubble generating area.

Also, a liquid jet head using the aforesaid liquid jet head comprising:

a first structure for supplying a first liquid to the displacement area; and a second structure for supplying a second liquid different from the first liquid to the air bubble generating area in a state of the second liquid being separated from the first liquid.

Also, a liquid jet head using the aforesaid liquid jet head comprises:

means for carrying a recording medium to the printing area to provide liquid discharged from the head therefor; and driving means for providing driving condition for the electrothermal transducing elements of the head.

In this respect, the term "replacement area of the free end of the movable member" is a concept that includes the area in the vicinity of the liquid path area that presents the locus when the free end is displaced. The term "effective area of the air bubble" means the area of each electrothermal transducing area where each air bubble is essentially created excluding such surface where bubbling is not generating at the initial stage.

Under condition that the free end is positioned on the discharge port side than the fulcrum of the movable member, the present invention makes it possible to utilize the environment that facilitates the movement of the free end of each movable member for the formation of pressure inclination that enables the movement of the free end directly with respect to the directly inducing portion of the air bubble created in the effective bubbling area to the discharge port, which is placed on the front portion on the downstream side of the central part in the direction from the fulcrum to the free end of the movable member. In other words, the acoustic waves (compressional waves) generated in the effective bubbling area at the time of air bubble creation are propagated directly in liquid to form the pressure inclination (distribution) in the liquid on the displacement area reliably at the initial stage with respect to the displacement area (liquid flow path). As a result, it becomes possible to increase the shifting amount toward the discharge port in the liquid residing in the moving direction of the movable member on the free end and in the vicinity of the free end of the movable member.

Also, in accordance with the present invention, it is possible to shift the liquid dividing area that disperses the flow of liquid to the fulcrum side of the surface area of the movable member in each of the displacement areas, thus stabilizing the discharge amount of liquid still more. This arrangement results in the enhancement of the discharging efficiency, and in the rationalized refilling function when liquid is refilled, thus leading to a shorter refilling period.

Also, in accordance with the reflection of the acoustic waves or the structure of induction itself of the present invention, the aforesaid pressure inclination (distribution) can be intensified independently. Therefore, it is possible to move liquid as desired. With this reflection or the inductive structure provided in addition to the effective bubbling area that directly faces the displacement area in accordance with the present invention, the formation of the aforesaid environment becomes more reliable and presents excellent effect. Also, by the utilization of this structure, it becomes possible to implement the induction of the air bubbles to the discharge port side more rationally to enhance the overall of discharging effect of an invention to be described later, which will be added to the first invention in the claim 1 as has been discussed above.

The advantages and features of the inventions hereof and the examples of structural variation will be clear to those skilled in the art by reference to the specific description given below.

In this respect, the terms "upstream" and "downstream" are related with the direction of liquid flow from the supply source of liquid to the discharge port through the air bubble generating area (or the movable member) or these terms are often used to express the structural direction thereof.

Also, the term "downstream side" of the air bubble itself represents the portion of the air bubble on the discharge port side, which mainly acts upon the discharge droplets directly. More specifically, it means the downstream side with respect to the center of the air bubble in the flow direction or the structural direction described above or the air bubble created in the area on the downstream side of the center of area of the heat generating element.

Also, the term "essentially closed" used in the description of the present invention means a state where the air bubble does not escape from the gap (slit) on the circumference of the movable member before the movable member is displaced at the time of the air bubble being created.

Further, the term "separation wall" referred to in the present invention means a wall (that may include the movable member) that resides to partition the air bubble generating area and the discharge port in a broader way, and also, means the partition between the flow path including the air bubble generating area and the liquid flow path conductively connected with the discharge port directly, in a narrower way, so as to prevent liquid in each of the areas from being mixed.

Furthermore, the term "essentially in contact" referred to the present invention includes a state where at least a part of the air bubble and the movable member are in contact physically, and a state where the development of the air bubble or the movement of the movable member is regulated, although a slight liquid film is present between the air bubble and the movable member.

DETAILED DESCRIPTION OF THE PREFERRED EMBODIMENTS

Embodiment 1

Hereinafter, with reference to FIGS. 1A to 1C and FIG. 4 to FIG. 7, the detailed description will be made of a first embodiment in accordance with the present invention.

At first, the description will be made of an example in which the discharging power and the discharging efficiency are enhanced by controlling the propagating direction of pressure exerted by the creation of each air bubble, and the developing direction of the air bubble for discharging liquid in accordance with the present embodiment.

Figure 1A:
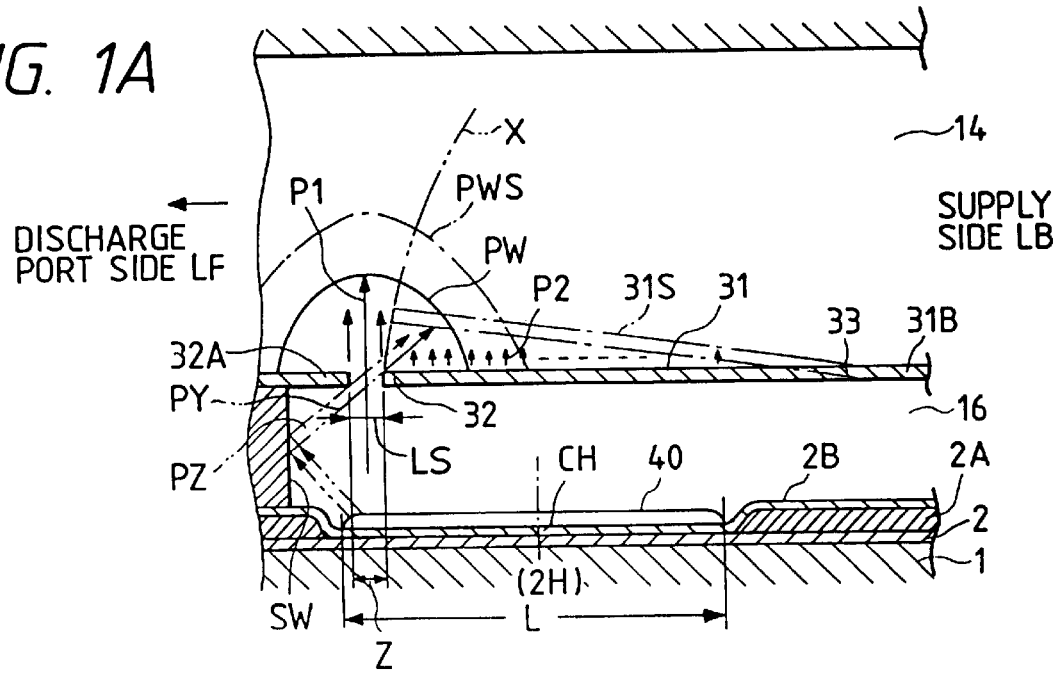
FIG. 1A is a cross-sectional view schematically shows one example of the liquid jet head in accordance with the present invention.
Figure 1B:
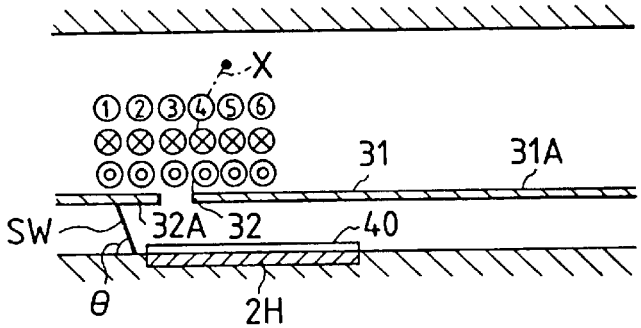
FIGS. 1B and 1C are views illustrating the pressure distribution in the head.
Figure 1C:
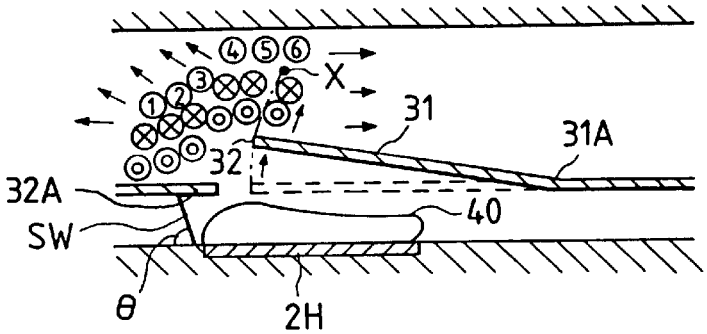
Figure 4:
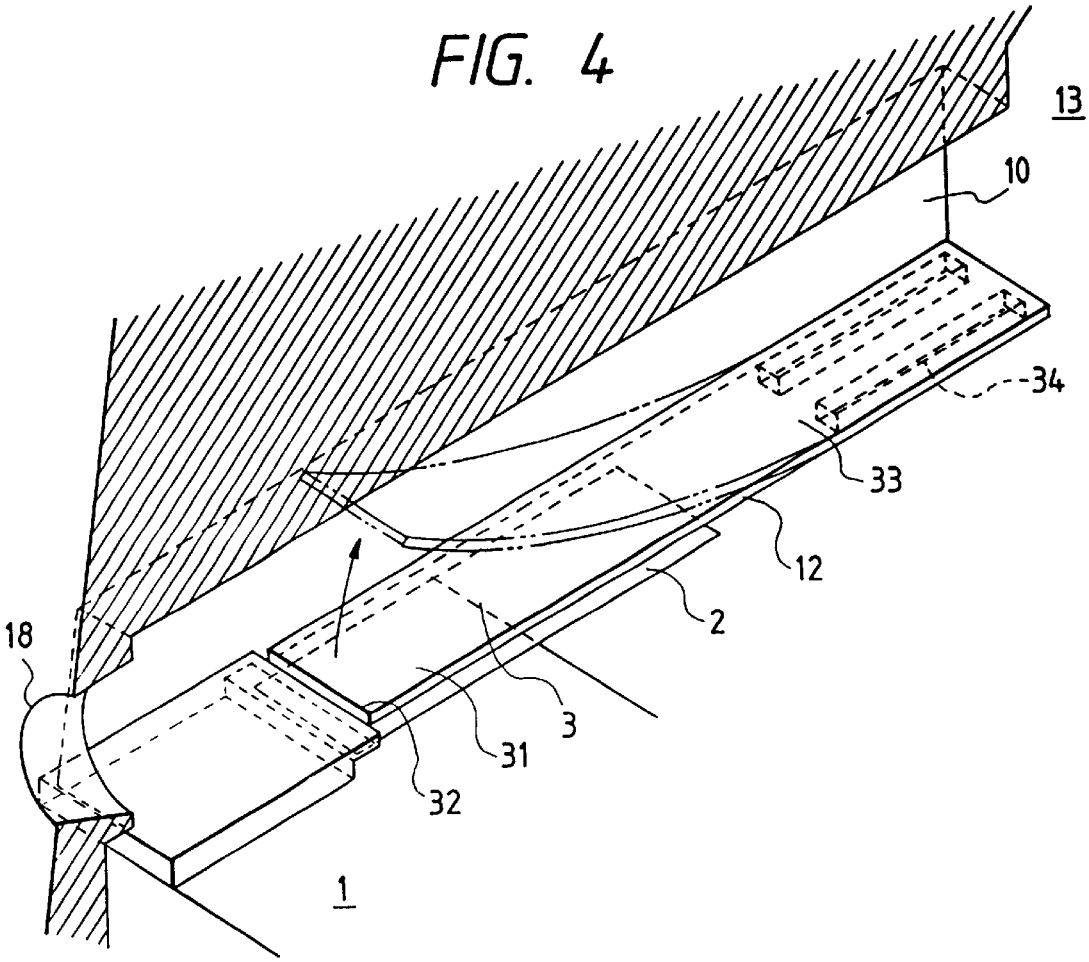
FIG. 4 is a partially broken perspective view which illustrates the liquid jet head represented in FIGS. 1A, 1B and 1C.

FIG. 1A is a cross-sectional view which shows the liquid jet head 1 of the present embodiment, taken in the direction of the liquid flow path. FIGS. 1B and 1C are views which schematically illustrate the liquid jet head 1 represented in FIG. 1A. FIG. 4 is a partially perspective view which shows the liquid jet head represented in FIGS. 1A to 1C.

For the liquid jet head of the present embodiment, there are arranged on an elemental substrate 1, the heat generating elements 2 that causes thermal energy to act upon liquid (for the present embodiment, the electrothermal transducing elements serving as heat generating resistors, each having an effective bubbling area 2H of 40 $\mu$m×115 $\mu$m (whose length is L as shown in FIG. 1A)). On the elemental substrate 1, liquid flow paths are arranged corresponding to the heat generating elements 2. As clear from FIG. 4, each of the flow paths 10 is provided with a first liquid flow path conductively connected with a discharge port 18 (not shown), and is connected with a common liquid chamber 13 arranged to supply liquid to a plurality of the liquid flow paths. Each of the liquid flow paths receives liquid from the common liquid chamber 13 in an amount corresponding to the amount of liquid that has been discharged from the discharge port. As shown in FIG. 1A, the heat generating element 2 is provided with electrodes 2A and a protection layer 2 together to receive driving pulses through the electrode 2A for generating film boiling, thus creating the air bubble 40.

On the elemental substrate 1 forming this liquid flow path 10, a plate type movable member 31, which is formed by an elastic material such as metal (for the present mode, formed by Ni of 5 $\mu$m thick) and which is provided with a flat surface portion, is installed in a cantilever fashion. One end of the movable member 31 is fixed to a base (supporting member) 34 or the like, which formed by patterning photosensitive resin or the like on the wall of the liquid flow path 10 or on the elemental substrate 1. In this way, the movable member is supported, and at the same time, its fulcrum (fulcrum portion) 33 is constituted.

The movable member 31 has the fulcrum (fulcrum portion: fixed end) 33 on the upstream side of the large flow running from the common liquid chamber 13 to the discharge port 18 side through the movable member 31. It is also arranged away from the heat generating element 2 with a gap between them to cover the heat generating element 2 in a position to face the heat generating element 2 so that it has the free end (free end portion) 32 on the downstream side with respect to the fulcrum 33. In this respect, the kinds and configurations of the heat generating element 2 and the movable member 31 are not necessarily limited to those described above. It should be good enough if only these are configured and positioned to be able to induce the development of the air bubble to the discharge port, and to control the propagation of pressure as described later. Here, the liquid flow path 10 described above is divided into two areas for the sake of description of liquid flow, which will be taken up later. In other words, while the respective states of the movable member shown in FIGS. 1A, 1B, and 1C being set as boundary, the portion conductively connected with the discharge port 18 directly is defined as a first liquid flow path 14, and the portion provided with the air bubble generating area 11 and the liquid supply 12 as a second liquid flow path.

The heat generating element 2 is energized to cause heat to act upon liquid residing on the air bubble generating area 11 between the movable member 31 and the heat generating element 2, thus creating each air bubble by means of the film boiling phenomenon such as disclosed in the specification of U.S. Pat. No. 4,723,129. The pressure exerted by the creation of air bubble, and the air bubble act prior to displace the movable member 31 to be open widely to the discharge port side centering on the fulcrum 33 as shown in FIG. 4. By the displacement of the movable member 31 or the state of such displacement, the propagation of pressure exerted by the creation of air bubble and the development of the air bubble itself are led to the discharge port side.

Here, the description will be made of one of the fundamental principles of discharge, which is applied to the present invention. For the present invention, one of the most important principles is that the free end of the movable member, which is arranged to face the air bubble generating area, and which is arranged on the downstream side of the center CH (3 in FIG. 4), is priorly displaced from the first position in the stationary state to the second position after the maximum displacement by means of the pressure distribution at the time of air bubble creation, which is improved by the sectional area for air bubble creation area Z (for the present mode, 10 $\mu$m long) where the air bubble generating area does not face the movable member following the creation of air bubble, thus allowing the liquid dividing area having the different directions of liquid movement to shift from the surface of the movable member to the fulcrum 33. In this way, more liquid is allowed to shift to the discharge port side, hence making it easier for the movable member to be displaced, and at the same time, to direct the developing direction of the air bubble toward the discharge port side more reliably.

Now, this principle of discharge will be described further in detail with the comparison between FIG. 5 which schematically shows the conventional structure of liquid flow path without using any movable member, and FIG. 6 which schematically shows the structure of liquid flow path using the movable member as described above. Here, the propagating direction of pressure toward the discharge port is designated by a reference mark $V_A$, and the propagating direction of pressure toward the upstream side as $V_B$.

Figure 5:
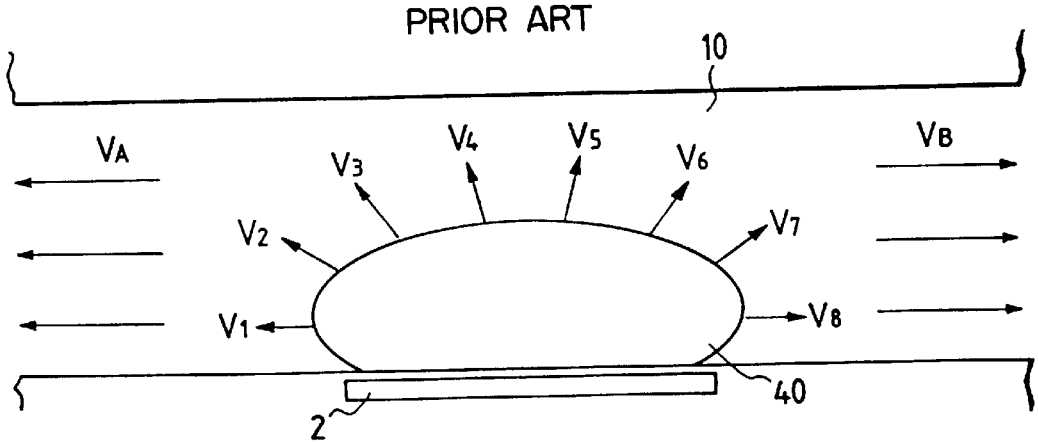
FIG. 5 PRIOR ART
FIG. 5 is a view which schematically shows the pressure propagation from an air bubble in accordance with the conventional head.

As shown in FIG. 5, the conventional head is not provided with any structure that regulates the propagating direction of pressure exerted by the created air bubble 40. As a result, the directions of pressure exerted by the air bubble 40 become those of the normal lines on the surface of the air bubble as indicated by the reference marks $V_1$ to $V_8$, and the pressure is directed variously. Of these directions, those designated by the marks $V_1$ to $V_8$ are provided with the components in the pressure propagating directions toward the $V_A$ that particularly affects the liquid discharging most, that is, the components in the pressure propagating directions nearer to the discharge port from the position almost half of the air bubble. These are in the important portions that contribute directly to the effectiveness of discharging efficiency, discharging power, discharging speed, and some others. Further, the one designated by the mark $V_1$ functions efficiently because it is in the direction nearest to that of $V_A$. On the contrary, the one designated by the mark $V_4$ contains a comparatively small directional component toward $V_A$.

Figure 6:
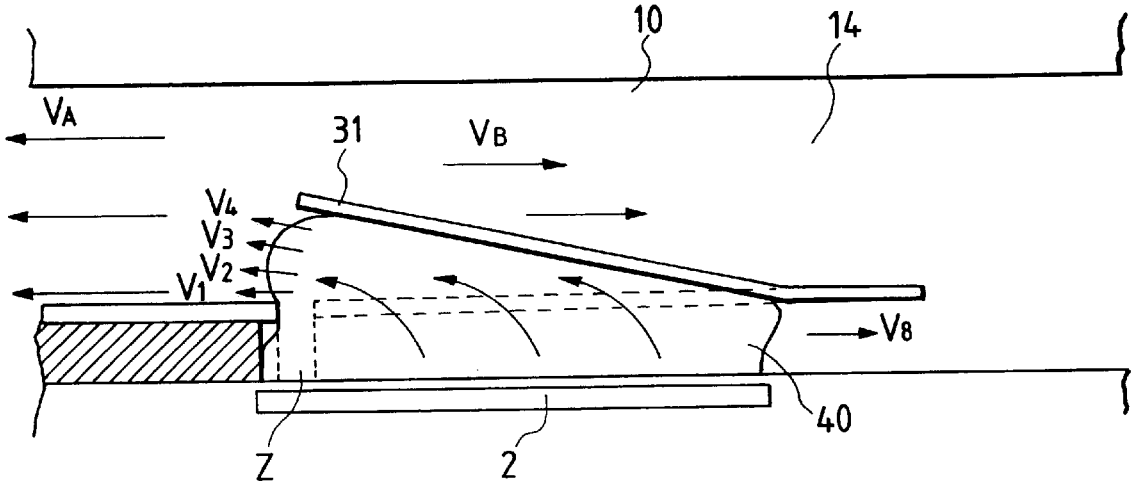
FIG. 6 is a view which schematically shows the pressure propagation from an air bubble in accordance with the head of the present invention.

Compared to this structural arrangement, the structure of the present invention shown in FIG. 6 is arranged to provide the movable member 31 including the free end, which has been priorly moved and displaced by the presence of the sectional area for air bubble creation area Z described earlier, functions to lead the pressure propagating directions $V_1$ to $V_4$ of the air bubble, which are directed variously as in the case shown in FIG. 5, to the downstream side (discharge port side) efficiently, and let them change into the pressure propagating direction designated by the reference mark $V_A$. In this way, the development of the air bubble 40 is directed toward the discharge port more, and the liquid is also allowed to shift to the discharge port side. Hence, the formation of pressure distribution by means of the sectional area for air bubble creation area Z contributes directly to discharging efficiently. Then, the developing direction of the air bubble itself is led in the downstream direction as in the pressure being propagated in the directions $V_1$ to $V_4$. As a result, the air bubble is developed larger in the downstream side than in the upstream side. In this way, the developing direction of the air bubble itself and the pressure propagating direction of the air bubble are controlled by means of the movable member, thus making it possible to attain the fundamental enhancement of the discharging efficiency, discharging power, and discharging speed, among some others.

In FIGS. 1A to 1C, and FIG. 4, the movable member 31 is positioned at least to face the downstream side of the air bubble with respect to the air bubble created by means of heat generated by the heat generating element 2. In other words, the movable member 31 is arranged in the structure of the liquid flow path at least up to a position in the downstream of the area center 3 of the heat generating element 2 (the down stream of the line passing the area center CH (3 in FIG. 4) of the heat generating element 2, which is orthogonal to the longitudinal direction of the flow path) in order to allow the downstream side of the air bubble 40 to act upon the movable member 31, that is, the sectional area for air bubble creation area Z is positioned on the downstream side of the area center CH (3 in FIG. 4), and the free end 32 that defines this area Z is also arranged to face the heat generating element 2 on the downstream side of the center CH (3 in FIG. 4).

As described above, the movable member positively contributes to leading the air bubble and the bubbling pressure in the direction of the discharge port 18, thus making it possible to control the pressure propagating direction and the developing direction of the air bubble efficiently. After that, when the air bubble 40 is contracted due to the reduction of the pressure in the air bubble subsequent to the film boiling described earlier, and disappears, the movable member 31 returns to the initial position shown in FIG. 1B (the first position) by means of the negative pressure exerted by the contraction of the air bubble and the restoring force provided by the elasticity of the movable member 31 itself as well. Also, when the air bubble disappears, liquid is caused to flow in from the supply side LB on the upstream side, that is, the liquid flow from the common liquid chamber side, and also, from the discharge port side LF, in order to make up the contracted volume of the air bubble on the air bubble generating area 11, as well as the voluminal portion of liquid that has been discharged.

For the present embodiment, the movable member 31 is provided. Therefore, given the upper side of the volume W of the air bubble as W1, and the air bubble generating area 11 side thereof as W2, while defining the first position of the movable member 31 as boundary, the regression of the meniscus comes to a stop when the movable member 31 returns to the original position at the time of disappearance of bubbles. After that, the voluminal portion of the remaining W2 is made up by the liquid supply mainly from the second liquid flow path 16. In this way, whereas the regressive amount of the meniscus becomes as large as almost a half of the volume of the air bubble W conventionally, it is possible to suppress the regressive amount of the meniscus to almost a half of the W1, which is already smaller than the conventional amount of the meniscus regression.

Further, the liquid supply for the voluminal portion W2 can be executed compulsorily mainly from the upstream side of the second liquid flow path along the surface of the movable member 31 on the heat generating element side. Therefore, refilling can be implemented at a higher speed.

Here, characteristically, when refilling is executed using the pressure exerted at the time of deforming for the conventional head, the vibration of meniscus becomes great, leading to the degrading of image quality. However, with the high-speed refilling described above, it is possible to make the vibration of the meniscus extremely small, because the liquid flow is suppressed on the area of the first liquid flow path 14 on the discharge port side and the air bubble generating area 11 on the discharge port side as well.

Thus, with the present invention, it is possible to attain the compulsory refilling to the air bubble generating area 11 through the second liquid flow path 16 of the liquid supply path 12, and also, attain the high-speed refilling by suppressing the regression and vibration of the meniscus as described above. As a result, the stabilized discharges and high-speed repetition of discharges can be performed reliably. Also, when applying it to recording, the enhancement of image quality and high-speed recording are made possible.

Further, the structure as arranged in accordance with the present invention provides the effective functions dually as given below. In other words, it is possible to suppress the propagation of pressure (back waves) exerted by the creation of the air bubble to the upstream side. In an air bubble created on a heat generating element 2, most of the pressure exerted by the air bubble on the common liquid chamber side (upstream side) becomes a force (the back waves) that pushes back liquid to the upstream side in the conventional art. The back waves bring about not only the pressure on the upstream side, but also, the shifting amount of liquid caused thereby, which inevitably exerts the inertial force following such shifting of liquid. This event results also in the unfavorable performance of liquid refilling into the liquid flow paths, leading to the hindrance of high-speed driving. In accordance with the present invention, such action working upon the upstream side is suppressed at first by means of the movable member 31. Then, it is made possible to enhance the performance of refilling supply still more.

Now, the description will be made of the structures and effects more characteristic to the present embodiment.

The second liquid flow path 16 of the present embodiment is provided with a liquid supply path 12 having the inner wall (where the surface of the heat generating element does not fall down remarkably), which is essentially connected with the heat generating element 2 flatly on the upstream of the heat generating element 2. In such a case, the liquid supply to the air bubble generating area 11 and to the surface of the heat generating element 2 is executed along the surface of the movable member 31 on the side nearer to the air bubble generating area 11. As a result, the stagnation of liquid on the surface of the heat generating element 2 is suppressed to make it easy to remove the deposition of gas remaining in liquid, as well as the so-called remaining bubbles yet to be disappeared. Also, there is no possibility that the heat accumulation on liquid becomes too high. Therefore, it is possible to perform more stabilized creation of air bubbles repeatedly at high speeds. In this respect, the description has been made of the liquid supply path 12 having an inner wall, which is essentially flat, but the present invention is not necessarily limited to it. It should be good enough if only the liquid supply path has a smooth inner wall connected with the surface of the heat generating element smoothly, and is configured so that there is no possibility that liquid is stagnated on each of the heat generating elements and that any large disturbance of flow takes place in supplying liquid.

Figure 7:
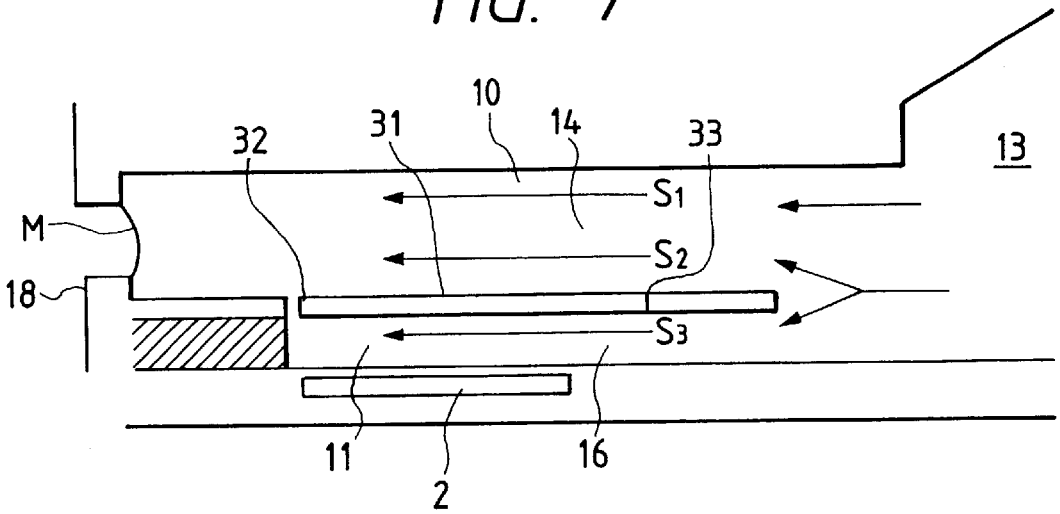
FIG. 7 is a view which schematically illustrates the liquid flow in accordance with the present invention.

Now, as to the positions of the free end 32 and the fulcrum 33 of the movable member 31, it is arranged that the free end is relatively on the downstream side than the fulcrum as shown in FIG. 1A and FIG. 7. Since the structure is arranged in this way, it becomes possible to implement the function to lead the pressure propagating direction and developing direction of the air bubble toward the discharge port side efficiently at the time of bubbling as described earlier. Further, with this positional relationship, not only a favorable effect is produced on the discharging functions, but also, the flow resistance is made smaller for liquid running in the liquid flow path 10 at the time of supplying liquid, thus obtaining such effect as to operate refilling at a higher speed. This is because, as shown in FIG. 7, the free end and the fulcrum 33 are arranged not to present resistance to the flows S1, S2, and S3 running in the liquid flow path 10 (including the first liquid flow path 14 and the second liquid flow path 16) when the meniscus M, which has regressed due to discharging, returns to the discharge port 18 by means of capillary force or when liquid supply is supplied subsequent to disappearance of bubbles.

To supplement this, as shown in FIGS. 1A to 1C, and, FIG. 4, the free end 32 of the movable member 31 extends over the heat generating element 2 to face the downstream side thereof of the area center 3 (that is the line orthogonal to the longitudinal direction of the liquid flow path, passing the area center (central portion) of the heat generating element), which divides the heat generating element 2 into the upstream side and the downstream side. In this way, the pressure generated on the heat generating element 2 on the downstream side of the area center 3 thereof is received by the movable member 31, which contributes greatly to liquid discharging, or the air bubble development. Thus, the pressure and air bubble are led to the discharge port side for the fundamental enhancement of the discharging efficiency and discharging power.

Further, the upstream side of the air bubble is also utilized to produce many favorable effects.

Also, with the structure of the present embodiment, the free end 32 of the movable member 31 effectuates a mechanical displacement instantaneously. This function is also considered to contribute effectively to discharging liquid.

Now, reverting to FIGS. 1A to 1C, the description will be made to supplement the structural condition and function of the sectional area for air bubble creation area Z.

The heat generating resistor 2 shown in FIGS. 1A to 1C is made by a heat generating element formed by the electrode 2A and the protection layer 2B. The effective bubbling area 2H becomes an area having a length L, which is slightly shorter than the length of the heat generating element 2. For the present embodiment, the communicating portion conductively connected with the first liquid flow 14 is arranged in a length LS (between the separation wall 32A and the free end in FIGS. 1A to 1C), which does not face the movable member 31. The effective bubbling area of the heat generating element 2 that faces this communicating portion becomes the sectional area for air bubble creation area Z.

This sectional area for air bubble creation area Z is positioned in the vicinity of the end of the downstream side of effective bubbling area 2H, but, more preferably, it should include this end of the downstream side in order to enhance the discharging efficiency still more. As described above, the length of the area Z (which is related to the direction from the fulcrum 33 to the free end 32) is set at Z=10 $\mu$m against L=115 $\mu$m in accordance with the present embodiment. Then, this area is positioned on the downstream side of the center CH (numeral 3 in FIG. 4) of the effective bubbling area. Therefore, the effective bubbling area is arranged to face the movable range of the movable member 31 sufficiently. In this way, a half of the air bubble, which resides on the discharge port side, faces the movable member. Consequently, the development of the air bubble is controlled by means of the movable member, thus leading it in the first liquid flow path 14 in the direction toward the discharge port side LF more reliably and stably.

As shown in FIG. 1A, the function, which is effectuated by means of the sectional area for air bubble creation area Z in the first liquid flow path through the communicating portion described above, makes it possible to utilize the transfer of the acoustic waves for the formation of the environment that facilitates the movement of the free end with respect to the formation of pressure inclination that controls the movement of the free end 32 directly. In this way, it becomes possible to enhance the overall discharge efficiency, that is, with respect to the displacement area of the movable member (liquid flow path), the acoustic waves (compressional waves) exerted in the effective bubbling area at the time of bubbling are directly propagated in liquid to form the pressure inclination (distribution) in liquid within the displacement area reliably at early stage. As a result, the amount of liquid, which is positioned in the moving direction of the free end of the movable member and on the surface of the movable member in the vicinity of the free end, is increased and directed to shift toward the discharge port.

In FIG. 1A, the acoustic waves P1 (which is directly propagated) and P2 (which is propagated through the movable member) are transferred at a speed of approximately 1,000 m/sec in a period of 0.2 $\mu$sec before the air bubble 40 is formed. Therefore, the pressure inclination is formed when it reciprocates in the liquid flow path (the traveling distance being 100 $\mu$m or less at the maximum). The curved line PW indicates this pressure distribution schematically. The distribution is maximized in the vicinity of the free end 32 of the movable member. From that point, it presents the environment that enables liquid to move greatly in the first liquid flow path 14 corresponding to the surface of the movable member directed to the fulcrum 33 side of the movable member. In other words, it is possible to shift the liquid dividing area, which disperse the flow of liquid respectively to the discharge side and the fulcrum side in the displacement area, to the fulcrum side on the surface area of the movable member. As a result, the discharge amount of liquid is stabilized still more to enhance the discharging efficiency, while executing the refilling function rationally at the time of refilling, thus contributing to making the refiling period shorter.

In this respect, the reference mark PWS indicates the case where the pressure inclination is intensified by means of the pressure distribution P1, and indicates that it is possible to expand the range in which the initial force is given to liquid for its shift to above the surface of the movable member and the fulcrum side. The line PWS of the pressure distribution is obtainable in a larger curvature as the length LS of the communicating portion (between the separation wall 32A and the free end of the movable member that faces it) becomes longer. However, it is smaller than L/2, because the free end 32 should be placed at least on the upstream side of the center CH (numeral 3 in FIG. 4), which is a half of the length L of the effective bubbling area, In practice, although depending on the length L of the effective bubbling area, it is preferable to set such length in a range of 5 $\mu$m or more to 30 $\mu$m or less. Also, for the present embodiment, the communicating portion is arranged to face the inner side of the range of the effective bubbling area L. However, with efficiency in view, it is preferable to arrange this portion to face the area including the downstream end of the area L. Also, a reference mark 31S designates the displacement of the movable member partly; and X, the locus of the free end 32.

FIGS. 1B and 1C are views which schematically illustrate the pressure distribution by means of the acoustic waves, and the formation of liquid dividing area described above in accordance with the structure represented in FIG. 1A.

In a state where the air bubble is created as shown in FIG. 1B, the particles indicated by liquid designated by ① to ⑥, and by six marks of Ⓧ and six marks of ⊙ in three lines and six columns are those to which traveling acceleration is given by means of the pressure distribution described above. After that, as the movable member shifts, the volume of the air bubble 40 increases. At that time, however, a majority of these particles shift in the discharge port side LF, and it is understandable that the liquid dividing area is formed on the fulcrum side of the portion indicated by ⑥, the mark Ⓧ, and the mark ⊙. At the same time, as understandable from the traveling directions of each particle shown in FIG. 1C, the space between the separation wall 32A and the free end 32 becomes a zone having such a high compression as may be in high density because liquid flows in from the upstream side of the first liquid flow path. On the other hand, this space presents the environment that facilitates the air bubble 40 to shift. Then, as shown in FIG. 6, the air bubble 40 is caused to shift to the discharge port side, and controlled by the movable member 31 essentially.

In FIGS. 1A, 1B, and 1C, the inclined surface SW is provided as a structural element in the second liquid flow path 16 for use of acoustic wave reflection that allows the pressure distribution to change slightly. This inclined surface SW leads such parts PY and PZ of the acoustic waves generated at the end portion of the area L at the time of bubbling to the first liquid flow path on the fulcrum side on the surface of the movable member through the communicating portion described above. The modification effect provided for the pressure distribution by means of this inclined surface SW is desirable, because it makes the liquid supply possible in a quantity that compensates the variation resulting from changes in environment.

As shown in this example, it is possible to intensify the pressure inclination (distribution) described above independently by means of the acoustic wave reflection or the inductive structure itself, and also, to effectuate the shifting of liquid as desired. When this reflection or the inductive structure is arranged in addition to the provision of the effective bubbling area that faces the displacement area directly in accordance with the present invention, the formation of the environment described above is provided more reliably in excellent condition. Also, it becomes possible to lead an air bubble to the discharge port side more rationally by the utilization of this structure. Therefore, the invention (which will be described later) to be added to the invention according to claim 1 which contributes to the overall enhancement of the discharging efficiency.

Here, this reflection or the inductive structure includes the function that changes the transfer coefficient of the acoustic waves of the movable member itself, as well as the configuration of the free end or the portion that forms the communicating portion that faces the free end, that is, the configuration of the separation wall 32A.

FIGS. 2A to 2D and FIGS. 3A and 3B are views that illustrate the structural examples of head, each having the communicating portion (sectional effective bubbling area Z) which constitutes the fundamental structure as represented in FIGS. 1A to 1C as prerequisite.

Now, FIGS. 2A to 2D and FIGS. 3A and 3B will be described briefly as given below.

Figure 2A:
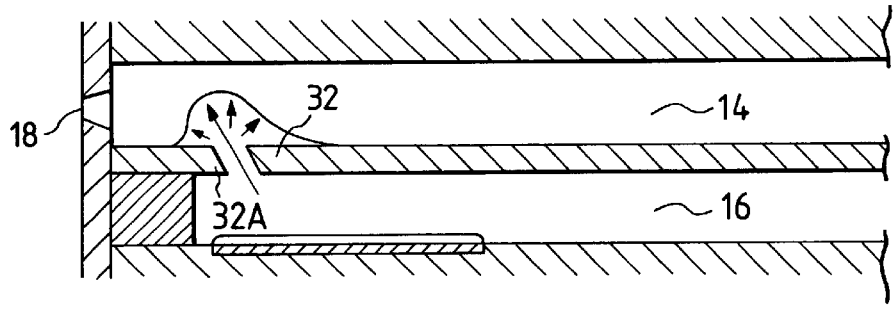
FIGS. 2A, 2B, 2C and 2D are partial broken views which illustrate the examples of the liquid jet head in accordance with the present invention.
Figure 2B:
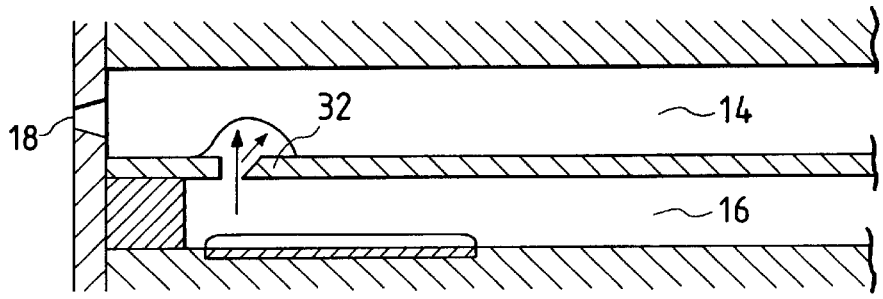

FIG. 2A shows the separation wall 32A and the free end 32, which are both inclined in the direction to lead the acoustic waves toward the discharge port side, thus enhancing the discharging characteristics relatively. FIG. 2B shows the configuration of the free end 32, which presents a slanted end surface inclined to the fulcrum side in order to provide the environment that facilitates the movement of the free end 32 itself.

Figure 2C:
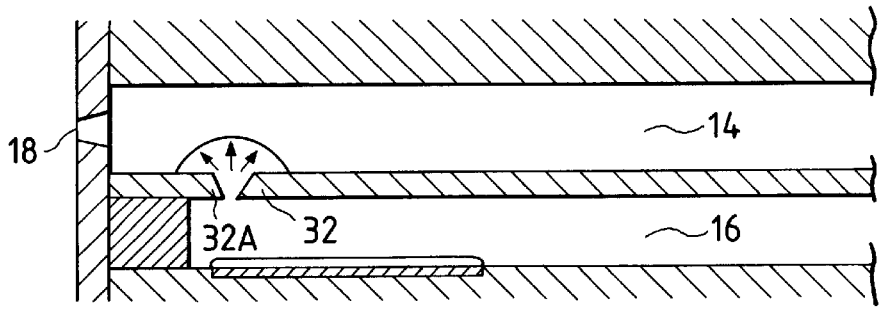

FIG. 2C shows a structure that enables the free end to move more easily by arranging the separation wall 32A and the free end 32 to be inclined in the different directions, thus making the length LS of the communicating portion longer on the first liquid flow path side for the expansion of the range of the large pressure distribution in the longitudinal direction of the movable member.

Figure 2D:
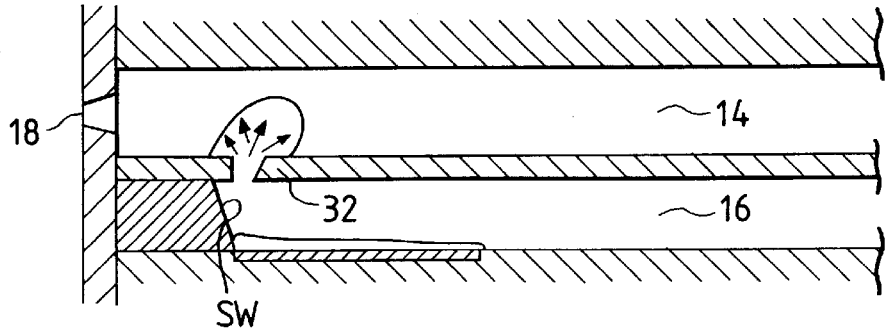

FIG. 2D is an structural element formed by adding the inclined surface SW shown in FIG. 1A to the structure shown in FIG. 2B in order to improve the pressure distribution as shown in FIG. 2D for the formation of a better environment.

Figure 3A:
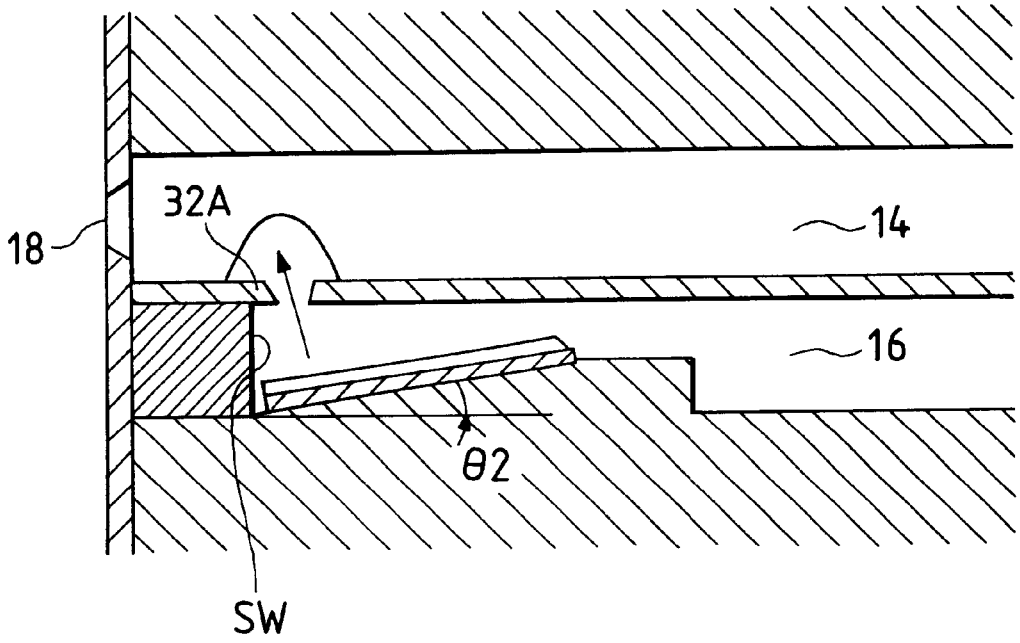
FIGS. 3A and 3B are partial broken views which illustrate the other examples of the liquid jet head in accordance with the present invention.

FIG. 3A shows a structure whereby to change the air bubble generating area with respect to the movable member 31, which makes it possible to propagate the acoustic waves of the effective bubbling area as a whole toward the discharge port side, and the same time, to enable the developing direction of the created air bubble to be directed toward the discharge port side more.

Figure 3B:
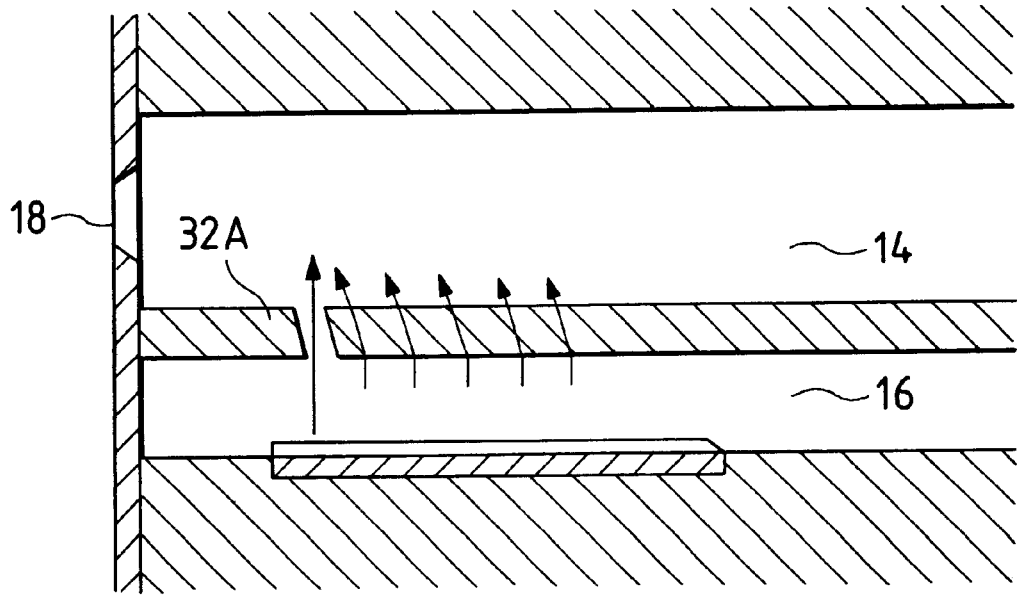

FIG. 3B shows the movable member, which is itself formed by a material capable of causing the acoustic waves to be refracted and directed toward the discharge port side in the first liquid flow path. Also, the communicating portion described above is structured as shown in FIG. 2A, thus enhancing the overall discharging performance.

As described above, in accordance with the discharging method of the present invention and the first head mode that implements such method, it is possible to obtain effects remarkably superior to those obtainable by the conventional art, and also, obtain effects superior to those anticipated by the invention applied previously for a patent.

Now, with respect to the other modes of head and apparatus, the description will be made of its specific example in conjunction with FIG. 8 to FIG. 20. For such embodiments, it is needless to mention that any one of them satisfies the relations in which the aforesaid sectional effective bubbling area and the communicating portion are arranged to face each other in accordance with the present invention. Each structure and function are readily understandable by reference to the accompanying drawings provided accordingly. Therefore, the description thereof will be omitted.

Head Embodiment 2

Figure 8:
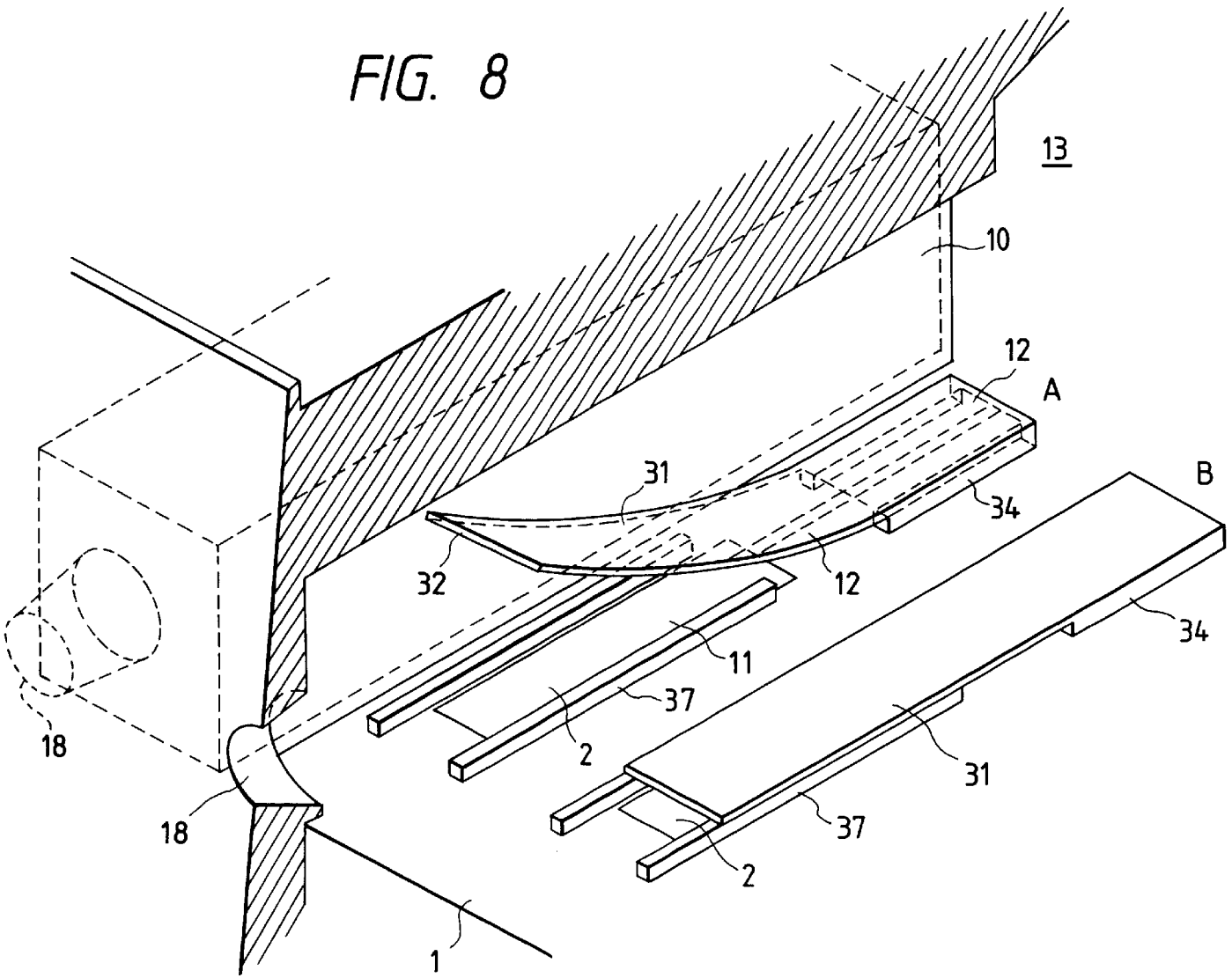
FIG. 8 is a partially perspective view which shows a liquid jet head in accordance with a second embodiment of the present invention.

FIG. 8 shows the head in accordance with a second embodiment of the present invention.

In FIG. 8, a reference mark A designates the state where the movable member is displaced (the air bubble is not shown); B, the state where the movable member is in the initial position (the first position). In the state at B, it is assumed that the air bubble generating area is essentially closed with respect to the discharge port 18 (here, although not shown, there is a flow path wall between A and B to separate a flow path from the other).

The movable member 31 in FIG. 8 is provided with two bases 34, each on either side, and between them, the liquid supply path 12 is arranged. In this way, liquid is supplied along the surface of the movable member 31 on the heat generating element side, and also, from the liquid supply path having essentially a flat or smooth surface with respect to the surface of the heat generating element 2.

Here, in the initial position of the movable member 31 (in the first position), the movable member 31 approaches closely or in close contact with the downstream wall 36 of the heat generating element and the side walls 37 of the heat generating element, which are arranged in the downstream side and in the width direction of the heat generating element 2. As a result, the pressure exerted by the air bubble at the time of bubbling is allowed to act upon the free end side of the movable member 31 intensively.

Also, at the time of disappearance of bubbles, the movable member 31 returns to the first position, and the air bubble generating area 31 is essentially closed on the discharge port side when liquid is supplied. As a result, it becomes possible to obtain various effects such as the suppression of the meniscus regression as described in conjunction with the previous embodiment.

Also, in accordance with the present embodiment, the base 34 that fixedly supports the movable member 31 is arranged on the upstream, which is away from the heat generating element 2 as shown in FIG. 4 and FIG. 8, and at the same time, the base is made smaller than the liquid flow path 10. In this way, liquid is supplied to the liquid supply path 12 as described earlier. Here, the configuration of the base 34 is not necessarily limited to the one referred to as above. It should be good enough, if only the base is configured to perform the refilling smoothly.

Head Embodiment 3

Figure 9:
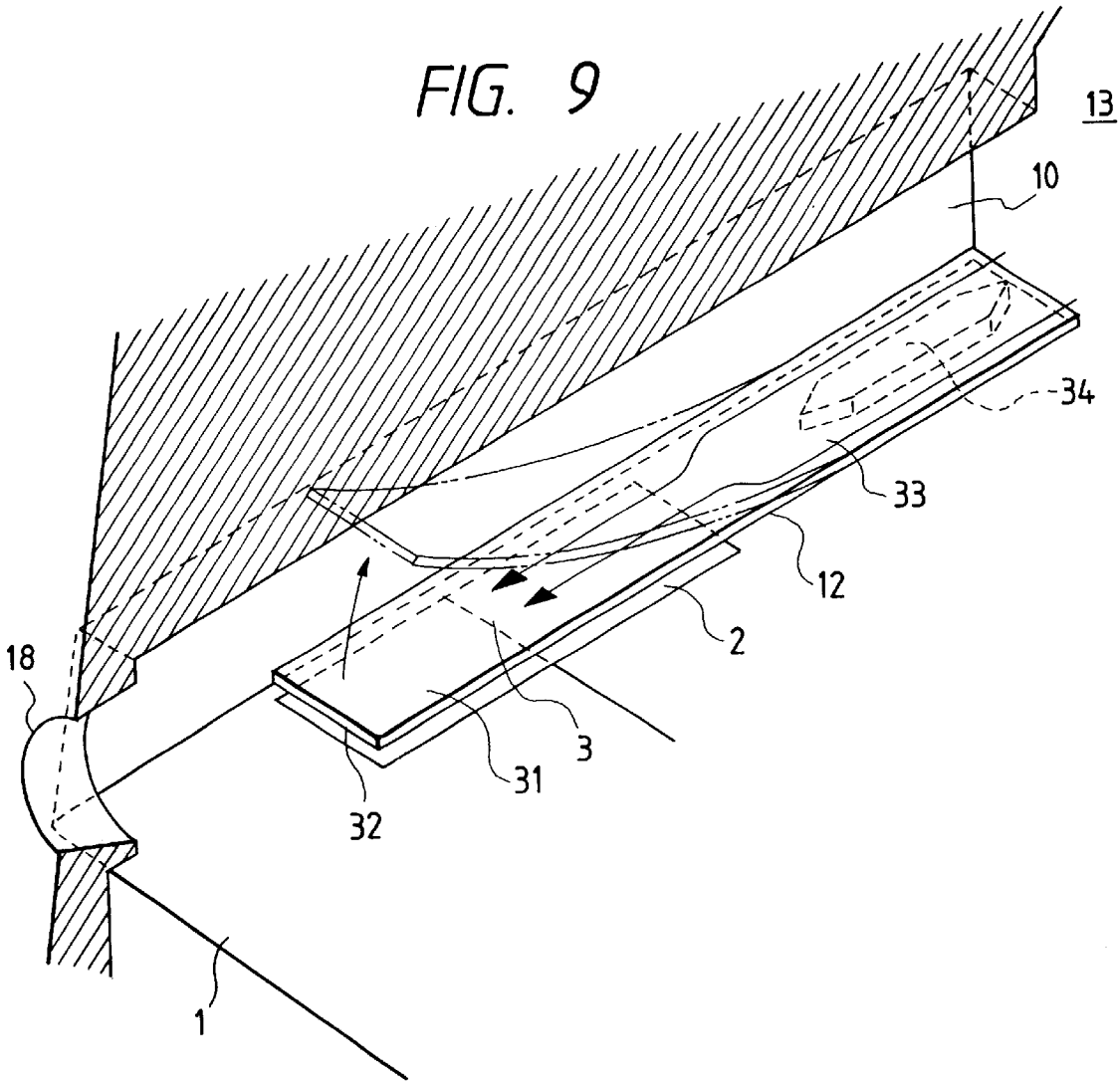
FIG. 9 is a partially perspective view which shows a liquid jet head in accordance with a third embodiment of the present invention.

FIG. 9 shows one of the fundamental concepts of the present invention, which is a head mode in accordance with a third embodiment of the present invention.

FIG. 9 shows the positional relationship between the air bubble generating area, the air bubble created therein, and the movable member in one of the liquid flow paths, and at the same time, it shows the liquid discharging method and the refilling method of the present invention in the mode embodying it for easier understanding.

For many of the embodiments described above, the pressure of the created air bubble is concentrated on the free end of the movable member to attain the concentration of the rapid movement of the movable member and the shift of the air bubble on the discharge port side simultaneously. In contrast, for the present embodiment, the portion of the air bubble on downstream side is regulated by the free end side of the movable member 31, which resides on the discharge port side of the air bubble directly acting upon the droplet discharge, while giving the degree of freedom to the air bubble to be created.

To describe this mode in accordance with the structure shown in FIG. 9 in comparison with the one shown in FIG. 4 (the first embodiment), there is no provision of the extrusion (at 24 in FIG. 4) serving as a barrier, which is positioned on the downstream end of the air bubble generating area arranged on the elemental substrate shown in FIG. 4. In other words, the area of the free end and the area of the both side ends of the movable member 31 do not close the air bubble generating area essentially but allow it to open to the discharge port area. This structure represents the present embodiment.

The present embodiment admits of the development of the air bubble at the leading end portion on the downstream side among those on the downstream side acting upon the droplet discharge effectuated by each of the air bubbles. Therefore, the pressure component thereof is effectively utilized for discharging. In addition, the side portions of the free end of the movable member 31 act upon at least the pressure directed above the downstream side portion (components of $V_2$, $V_3$, and $V_4$ in FIG. 5) to enable them to be added to the air bubble development. Therefore, the discharging efficiency is enhanced as in the previous embodiment described above. The present embodiment is superior to the previous one in the response to the driving of each heat generating element.

Also, the present embodiment has a simpler structure, leading to advantages on the aspect of manufacture.

The fulcrum of the movable member 31 of the present head embodiment is fixed on one base 34 having a smaller width with respect to the surface portion of the movable member. Consequently, at the time of disappearance of bubbles, liquid is supplied to the air bubble area 11 through both sides of this base 34 (see arrows in FIG. 9). This base may be structured in anyway if only it is made possible to secure a good supply capability.

For the present embodiment, the liquid flows in from above the air bubble generating area along the air bubble being defoamed when refilling is performed at the time of liquid supply. However this flow is controlled by the presence of the movable member 31. Therefore, this structure is superior to the conventional structure of the air bubble creation, which is formed only by the heat generating elements. It is of course possible to reduce the regressive amount of meniscus also by the structure thus arranged in accordance with the present embodiment.

As a mode of the third embodiment of head, it is preferable to arrange the structure so that only both side portions (or either one of them will do) of the free end of the movable member essentially close the air bubble generating area 11. With such structural arrangement, the pressure directed to the side ends of the movable member 31 is converted into the pressure applicable to the development of the air bubble on the discharge port side as described earlier, thus enhancing the discharging efficiency still more.

Head Embodiment 4

For the present embodiment, the main principle of liquid discharge is the same as the previous embodiment. However, the plural flow path structure is adopted to make it possible to separate liquid for bubbling by the application of heat (bubbling liquid) and liquid for use of discharge (discharging liquid) in accordance with the present embodiment.

Figure 10:
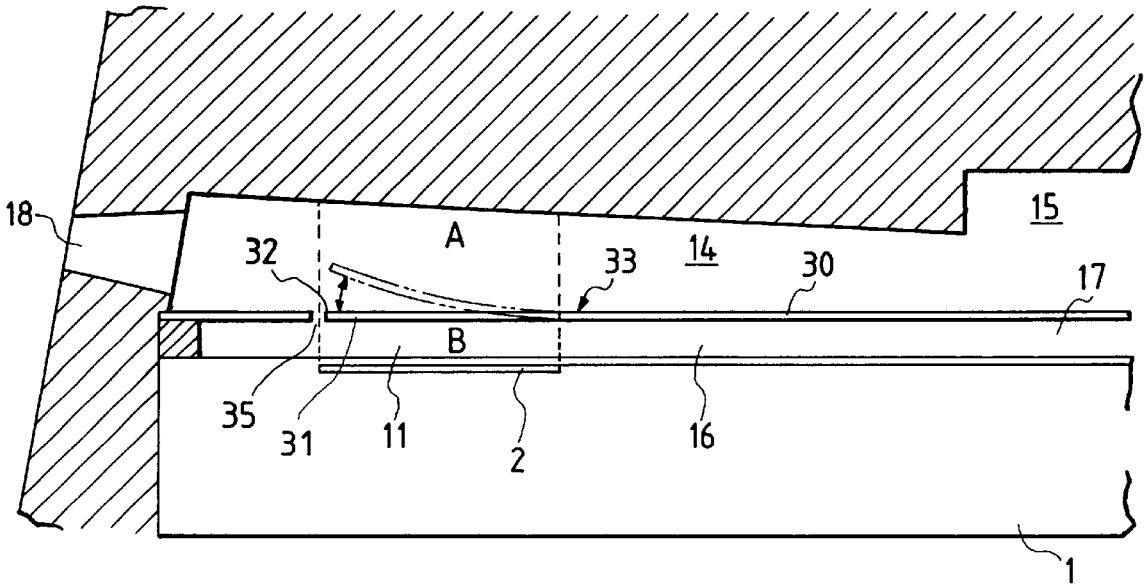
FIG. 10 is a cross-sectional view schematically showing the flow direction of a liquid jet head in accordance with the present invention.
Figure 11:
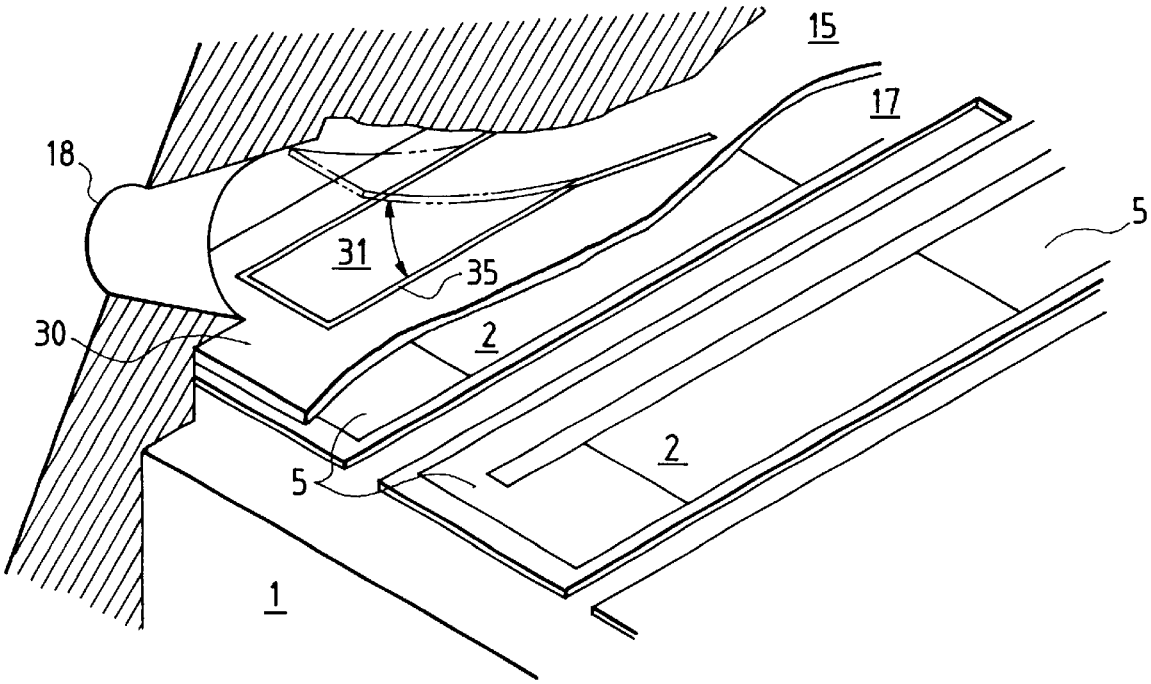
FIG. 11 is a partially perspective view which shows the liquid jet head represented in FIG. 10.

FIG. 10 is a cross-sectional view schematically showing the liquid jet head of the present embodiment, taken in the direction of flow path. FIG. 11 is a partly broken perspective view which shows the liquid jet head represented in FIG. 10.

For the liquid jet head of the present embodiment, each of the second liquid flow paths 16 for use of bubbling is arranged on the elemental substrate 1 having the heat generating elements 2 arranged on it to apply thermal energy to liquid for the creation of air bubbles, and on this liquid flow path, each of the first liquid flow paths 14 for use of discharging liquid is arranged, which is directly and conductively connected with each of the discharge ports 18.

The upstream side of the first liquid flow path is conductively connected with the first common liquid chamber 15 for supplying liquid to a plurality of first liquid flow paths. The upstream side of the second liquid flow path is conductively connected with the second common liquid chamber 17 for supplying bubbling liquid to a plurality of second liquid flow paths.

However, if the same liquid is used as bubbling liquid and discharging liquid, it may be possible to arrange one common liquid chamber for sharable use.

Between the first and second liquid flow paths, a separation wall 30, which is formed by elastic metal or the like, is arranged to partition the first liquid flow path and the second liquid flow path. In this respect, when bubbling liquid and discharging liquid should not be mixed as far as the circumstances permit, it is preferable to separate the distributions of liquid completely for the first liquid flow path 14 and the second liquid flow path 16 as much as possible. However, if there is no problem even if bubbling liquid and discharging liquid are mixed to a certain extent, it may be unnecessary to provide the separation wall with the function to separate them completely.

The portion of the separation wall, which is positioned in the projection space formed upward in the surface direction of the heat generating element (hereinafter referred to as discharge pressure generating area; the area at A and the air bubble generating area 11 at B in FIG. 10), is arranged to be in the form of a movable member 31 held in a cantilever fashion having its free end on the discharge port side (on the downstream side of the liquid flow) by means of a slit 35, and its fulcrum 33 on the common liquid chambers (15 and 17) side. Since the movable member 31 is arranged to face the air bubble generating area 11 (at B in FIG. 10), it operates to be open toward the discharge port side of the first liquid flow path side by bubbling of the bubbling liquid (that is, in the direction indicated by an arrow in FIG. 10). In FIG. 11, too, on the elemental substrate 1, which is provided with the heat generating resistors (electrothermal transducing elements) serving as heat generating elements 2, and wire electrodes 5 to apply electric signals to each of the heat generating resistors, the separation wall 30 is arranged through the space that constitutes the second liquid flow path.

The relationship between the arrangement of the fulcrum 33 and free end 32 of the movable member 31, and that of the heat generating element are made equal to those described in the previous embodiment.

Also, for the previous embodiment, the description is made for the structural relationship between the liquid supply path 12 and the heat generating element 2. For the present embodiment, too, the structural relationship between the second liquid flow path 16 and the heat generating element 2 is made equal to that described in the previous embodiment.

Now, in conjunction with FIGS. 12A and 12B, the description will be made of the operation of the liquid jet head of the present embodiment.

In order to drive the head, the same water ink is used as discharging liquid to be supplied to the first liquid flow path 14, and as bubbling liquid to be supplied to the second liquid flow path 16.

When heat generated by the heat generating element 2 acts upon bubbling liquid residing in the air bubble generating area 11 of the second liquid flow path 16, the air bubble 40 is created by means of the film boiling phenomenon brought about in bubbling liquid, such as disclosed in the specification of U.S. Pat. No. 4,723,129.

Figure 12A:
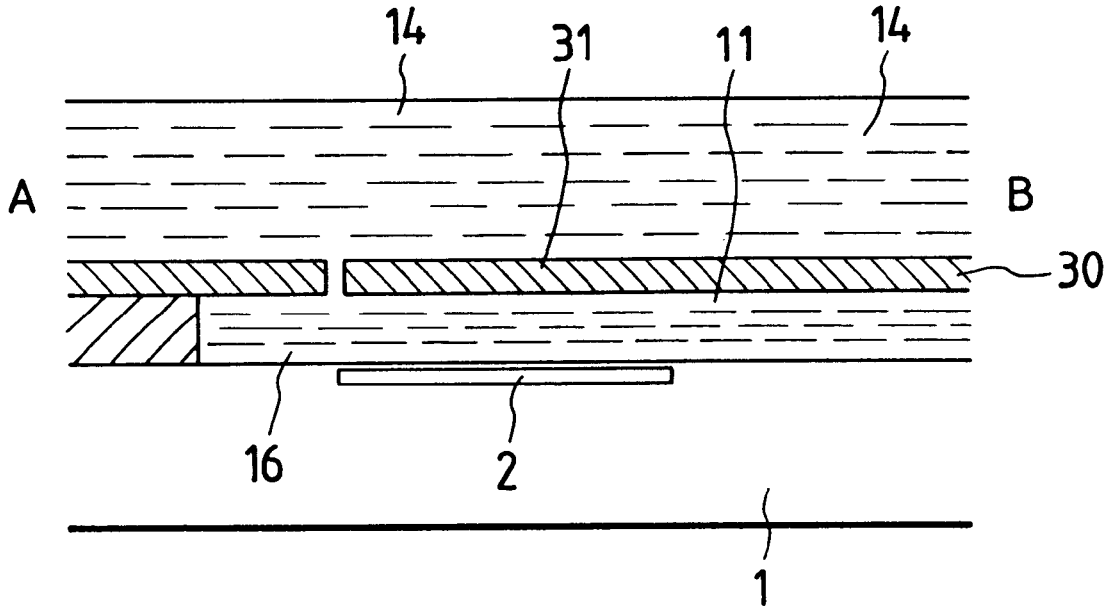
FIGS. 12A and 12B are views which illustrate the operation of the movable member.
Figure 12B:
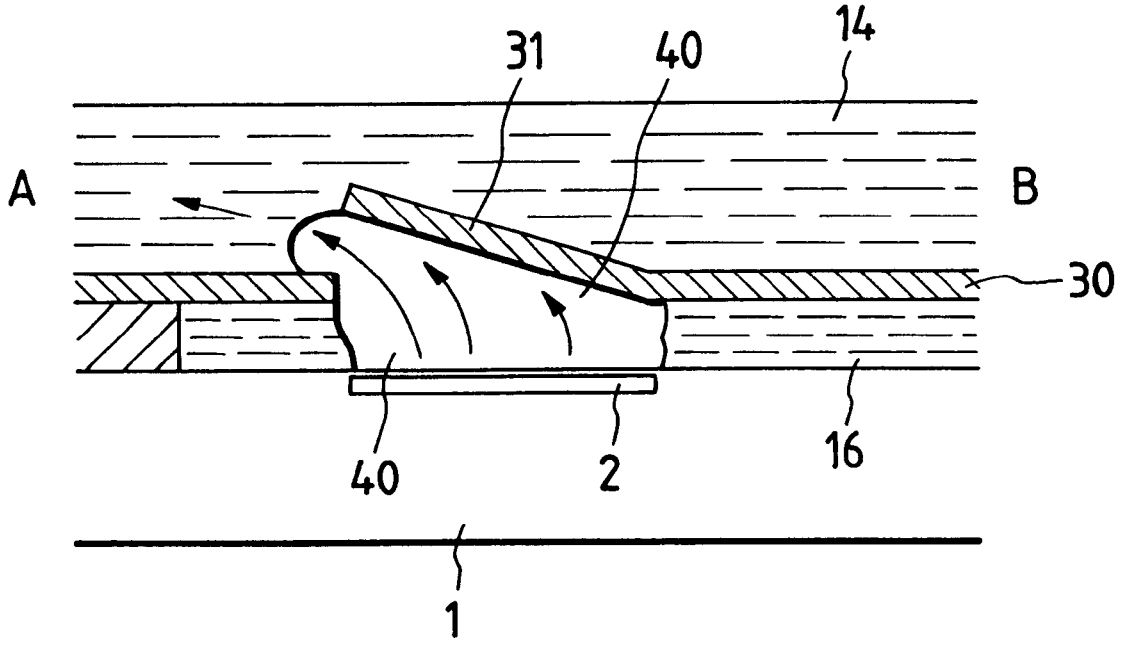

In accordance with the present embodiment, since no bubbling pressure escapes from three directions with the exception of the upstream side of the air bubble generating area, the pressure exerted by this air bubble creation is propagated intensively on the movable member 31 side arranged on the discharge pressure generating area, thus the movable member 31 is displaced from the state shown in FIG. 12A to the maximum displacement position together with the development of the air bubble. Then, the movable member 31 is displaced as it returns to the second liquid flow side by means of its elasticity as shown in FIG. 12B. By this series of operations of the movable member 31, the first liquid flow path 14 and the second liquid flow path are conductively connected largely, and the pressure exerted by the air bubble creation is controlled accordingly by the displacement of the movable member 31 returning to that side. In this way, the pressure is transferred mainly to the discharge port side of the first liquid flow path. With this propagation of pressure and the mechanical displacement of the movable member 31 as described above, liquid is discharged from each of the discharge ports.

Now, along the contraction of the air bubble, the movable member 31 returns to the position shown in FIG. 12A. Then, discharging liquid is supplied in the first liquid flow path 14 from the upstream side in an amount corresponding to the amount of discharge liquid that has been discharged. For the present embodiment, too, since the supply of the discharging liquid is made in the direction of the movable member 31 being closed as in the previous embodiment, there is no possibility that the refilling of discharging liquid is hindered by the presence of the movable member 31.

For the present embodiment, the functions and effects of the principal part are the same as the first embodiment and others with respect to the propagation of bubbling pressure following the displacement of the movable member 31, the developing direction of the air bubble, the prevention of back waves, and the like. However, with the provision of the two-flow structure of the present embodiment, the advantages are further obtainable as given below.

In other words, with the structures of the present embodiment as arranged described above, it is possible to discharge the discharging liquid by pressure exerted by the bubbling of the bubbling liquid, while using the discharging liquid and bubbling liquid as different liquids. Therefore, liquid having high viscosity, such as polyethylene glycol whose discharging power is insufficient to make sufficient bubbling difficult even by the application of heat, is also discharged in good condition by supplying the liquid, which effectuates good bubbling in bubbling liquid (such as a mixture of ethanol: water=4:6 of approximately 1 to 2 cp) or the liquid, which presents a low boiling point, to the second liquid flow path, while supplying such highly viscous liquid to the first liquid flow path.

Also, as bubbling liquid, it is possible to select liquid that does not produce burning or other deposits on the surface of the heat generating elements when receiving heat, thus stabilizing bubbling for discharging in good condition.

Further, with the head structure of the present invention, it is possible to obtain effects as described in each of the previous embodiments described above. Therefore, the adoption of the present embodiment further enhances the discharging efficiency and discharging power for discharging liquid having a higher viscosity or the like.

Also, even when a liquid whose properties are weak against the application of heat is used, it is possible to discharge such liquid with high discharging efficiency and high discharging power without giving any thermal damage to this liquid by supplying it to the first liquid flow path as discharging liquid, while supplying the liquid, which is capable of being foamed in good condition without changing its properties thermally, to the second liquid flow path.

(Relationship of Arrangement between the Second Liquid Flow Path and the Movable Member)

Figure 13A:
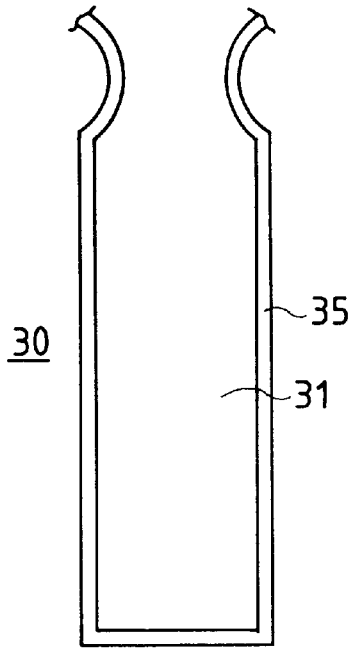
FIGS. 13A, 13B and 13C are views which illustrate the movable member and the structure of liquid flow path.
Figure 13B:
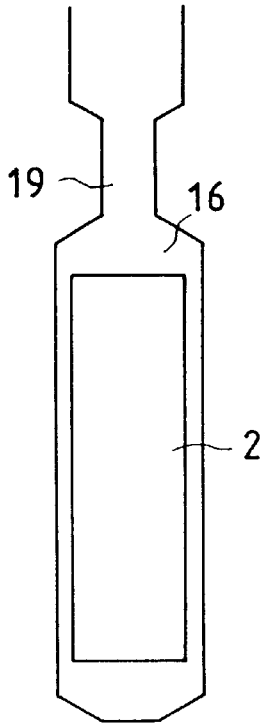
Figure 13C:
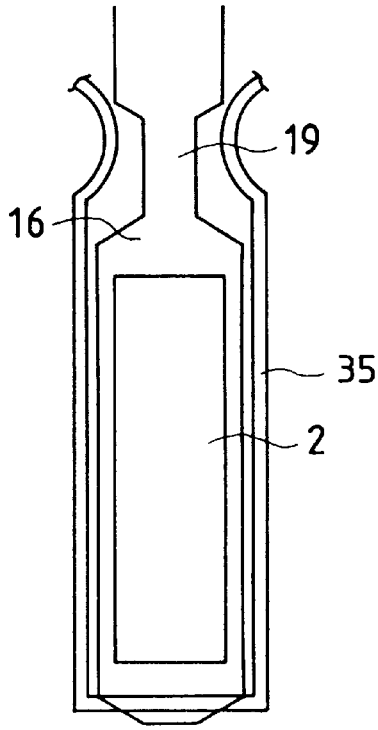

FIGS. 13A to 13C are views illustrating the relationship of the arrangement between the movable member 31 and the second liquid flow path 16; FIG. 13A shows the separation wall 30 and the vicinity of the movable member 31, being observed from above; FIG. 13B shows the second liquid flow path 16 after removing the separation wall 30, being also observed from above; and FIG. 13C is a view schematically showing the relationship of the arrangement between the movable member 31 and the second liquid flow path 16 by overlapping each of these elements. Here, all the figures illustrate the front side where the discharge port 18 is arranged underneath each one of them.

The second liquid flow path 16 of the present embodiment is provided with a narrower portion 19 on the upstream side of the heat generating element 2 (here, the upstream side means the one in the large flow from the second common liquid chamber side to the discharge port 18 through the position of the heat generating element, movable member 31, and the first liquid flow path), and this path is structured like a chamber (bubbling chamber) arranged to suppress bubbling pressure so that it does not escape easily to the upstream side of the second liquid flow path 16.

If such narrower portion should be provided for the conventional head, the bubbling and discharging paths of which are one and the same, in anticipation that pressure exerted by each of the heat generating elements on each liquid chamber side does not escape to the common liquid chamber side, it is necessary to arrange the structure so that the sectional area of the narrower portion is made too small for the liquid flow path, taking liquid refilling operation fully into consideration.

However, for the present embodiment, most of liquid in the first liquid flow path is used for discharging, while the arrangement can be made to suppress the consumption of bubbling liquid in the second liquid flow path where each of the heat generating elements is provided. It may be possible, therefore, that the refilling amount of bubbling liquid to the air bubble generating area 11 of the second liquid flow path is made smaller. As a result, the gap in the narrower portion described above is made as extremely small as several $\mu$m to ten and several $\mu$m in order to suppress further the escape of bubbling pressure exerted in the second liquid flow path to its circumference. Consequently, the pressure is led toward the movable member side intensively. Then, as this pressure can be utilized as discharging force through the movable member 31, it is possible to obtain higher discharging efficiency, as well as higher discharging power. In this respect, however, the configuration of the second liquid flow path 16 is not necessarily limited to the one adopted for the structure described above. It should be good enough if only such configuration is made so that the bubbling pressure is effectively led to the movable member 31.

In this respect, as shown in FIG. 13C, the side of the movable member 31 covers a part of the wall that constitutes the second liquid flow path 16 in order to prevent the movable member 31 from falling off into the second liquid flow path, making the separation more reliable between discharging liquid and bubbling liquid. Also, the escape of air bubble from the slit is suppressed in order to enhance both the discharging power and discharging efficiency still more. In this way, the refilling effect from the upstream side is also improved more by the utilization of pressure exerted at the time of disappearance of bubbles.

Particularly, the invention, which enables the free end of the movable member of the present invention to initiate its displacement before the air bubble is in contact with the movable member, is designed for its performance in consideration of the coefficient of elasticity of the movable member, the propagation performance of the discharging liquid and bubbling liquid, the driving condition for the air bubble creation or the mutual balance of the structures of each liquid flow path and the like. Therefore, the effects of the present invention is obtainable more easily if the movable member is easily deformed elastically, the transfer of pressure is more easily effectuated, and the resistance of the liquid flow path is smaller (against the movement of the movable member). In accordance with the present invention, pressure waves are led to the discharge port side at the time of bubbling. Therefore, the development of the air bubble that follows them is led to the discharge port side more reliably and efficiently.

(Movable Member and Separation Wall)

Figure 14A:
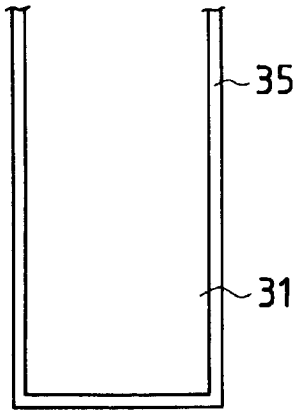
FIGS. 14A, 14B and 14C are views which illustrate the other configurations of the movable member.
Figure 14B:
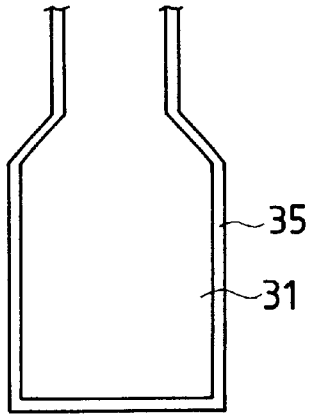
Figure 14C:
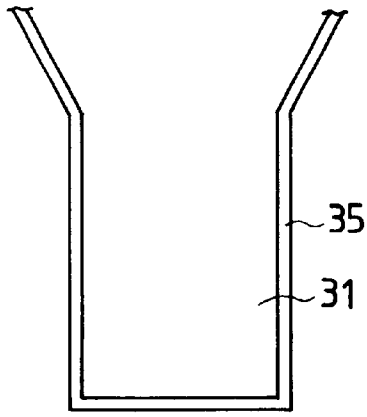

FIGS. 14A to 14C are views that show other configurations of the movable members 31. A reference numeral 35 designates each slit arranged for each of them. By means of the slit 35, each movable member 31 is formed. FIG. 14A shows an oblongly elongated configuration; FIG. 14B shows the configuration having narrower portion on the fulcrum side to facilitate the movement of the member; FIG. 14C shows the configuration having the wider portion on the fulcrum side to enhance the durability of the member. As the configuration that presents an easier movement and good durability, it is preferable to configure the member so that the width of its fulcrum side is made narrower in circular shape as shown in FIG. 13A. However, it should be good enough if only the movable member is configured not to occupy the second liquid flow path side, while facilitating its movement, but to present excellent durability.

For the previous embodiment, the flat type movable member 31 and the separation wall 30 having this movable member on it is formed by nickel of 3 $\mu$m thick. However, the material is not necessarily limited to it. As the material used to structure a movable member and a separation wall, it should be good enough if only such material has solvent resistance to bubbling liquid and discharging liquid, while having elasticity that admits of good operation as a movable member, and also, properties that enable a fine slit to be formed therefor.

For the material of the movable member, it is preferable to use highly durable metal, such as silver, nickel, gold, iron, titanium, aluminum, platinum, tantalum, stainless steel, or phosphor bronze, or alloys thereof, or resin having acrylonitrile, butadiene, styrene or other nitrile group, resin having polyamide or other amide group, resin having polycarbonate or other carboxyl group, resin having polyacetal or other aldehyde group, resin having polysulfone or other sulfone group, or resin having liquid crystal polymer or the like and its chemical compound, such metal as having high resistance to ink as gold, tungsten, tantalum, nickel, stainless steel, or tantalum, or its alloys and those having them coated on its surface for obtaining resistance to ink, or resin having polyamide or other amide group, resin having polyacetal or other aldehyde group, resin having polyether ketone or other ketone group, resin having polyimide or other imide group, resin having phenol resin or hydroxyl group, resin having polyethylene or other ethyl group, resin having polypropylene or other alkyl group, resin having epoxy resin or other epoxy group, resin having melamine resin or other amino group, resin having xylene resin or other methylol group, and its compounds, and further, ceramics such as silicon dioxide and its compound.

For the material of the separation wall, it is preferable to use resin having good properties of resistance to heat and solvent, as well as good formability as typically represented by engineering plastics in recent years, such as polyethylene, polypropylene, polyamide, polyethylene telephthalate, melamine resin, phenol resin, epoxy resin, polybutadiene, polyurethane, polyether ether ketone, polyether sulfone, polyarylate, polyimide, polysulfone, or liquid crystal polymer (LCP) and its compound or silicon dioxide, silicon nitride, nickel, gold, stainless steel or other metals, its alloys or those coated with titanium or gold.

For the movable member of the present invention, a thickness of $\mu$m order (t $\mu$m) it taken into account as objectives. There is no intention to use any movable member of cm order. When the width of slit of $\mu$m order (W $\mu$m) is taken up as objectives, it is desirable to consider some variation thereof resulting from the process of manufacture.

As a slit that satisfies the "essentially closed state" defined for the present invention, the slit produced in an order of several $\mu$m should be preferable for more reliable performance.

(Elemental Substrate)

Now, hereunder, the description will be made of the structure of an elemental substrate having heat generating elements arranged therefor to apply heat to liquid.

Figure 15A:
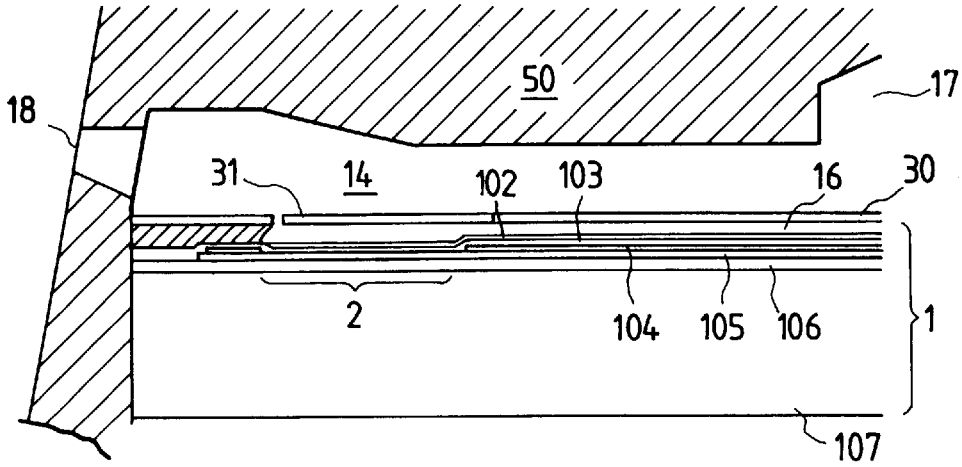
FIGS. 15A and 15B are vertically sectional view which illustrate a liquid jet head in accordance with the present invention.
Figure 15B:
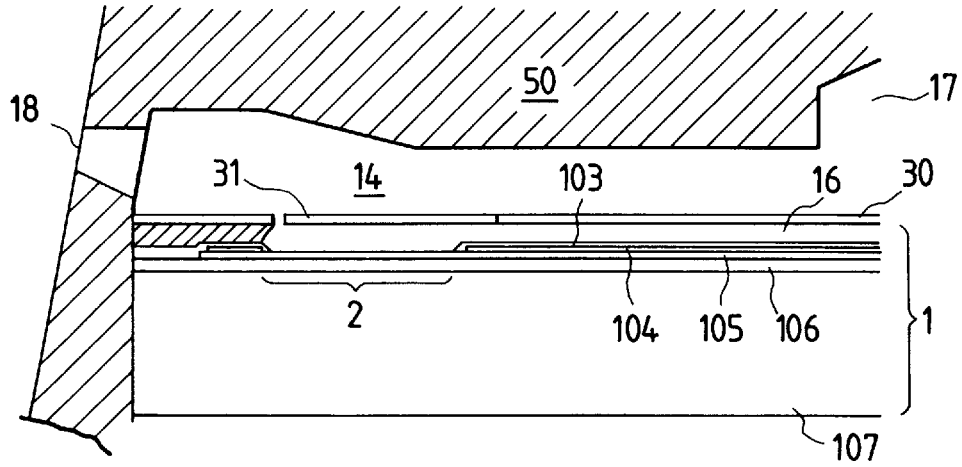
Figure 16:
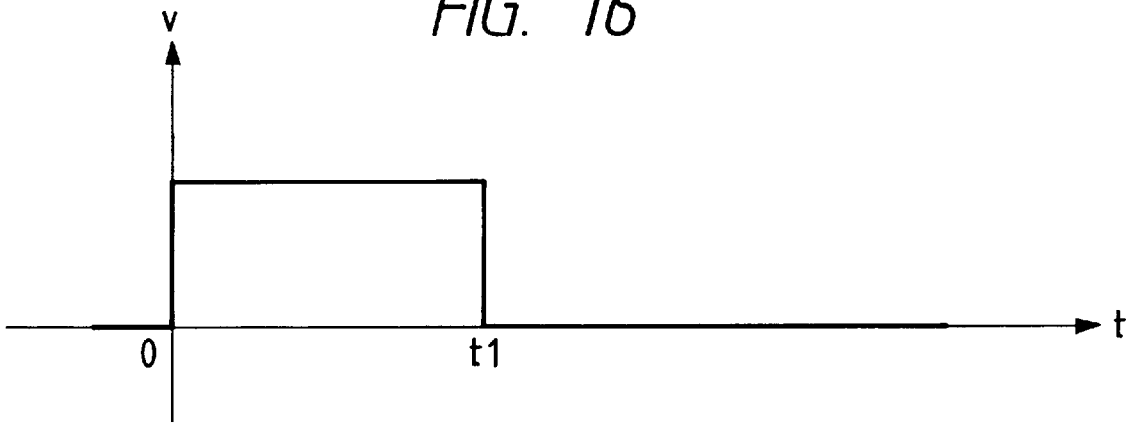
FIG. 16 is a view which schematically shows the shape of driving pulse.

FIGS. 15A and 15B are vertically sectional views of liquid jet heads of the present invention; FIG. 15A shows a head having a protection film to be described later; and FIG. 15B shows a head having no protection film.

On the elemental substrate 1, a grooved member 50 is arranged, which is provided with the second liquid flow path 16, the separation wall 30, and the first liquid flow path 14.

For the elemental substrate 1, silicon oxide or silicon nitride film 106 is formed on a substrate 107 of silicon or the like for the purpose of insulation and heat accumulation, and on it, hafnium boride ($HfB_2$), tantalum nitride (TaN), tantalum aluminum (TaAl) or other electric resistance layer 105 (0.01 to 0.2 $\mu$m thick) aluminum wire electrodes (0.2 to 1.0 $\mu$m thick) or the like, are laminated and patterned as shown in FIGS. 13A to 13C. Voltage is applied to the resistance layer 105 form two wire electrodes 104 to cause current to run on the resistance layer, thus generating heat. On the resistance layer across wire electrodes, a protection layer of silicon oxide or silicon nitride is formed in a thickness of 0.1 to 2.0 $\mu$m. Further, on it, an anti-cavitation layer of tantalum or the like is filmed (in a thickness of 0.1 to 0.6 $\mu$m). In this way, the resistance layer 105 is protected from ink or various other liquids.

Particularly, since the pressure and shock waves generated at the time of creating air bubble, and at the time of disappearance of bubbles are extremely strong, the durability of the rigid and brittle oxide film is reduced significantly. Therefore, the tantalum (ta) or other metal is used as an anti-cavitation layer.

Also, it may be possible to arrange a structure that does not require the protection layer described above by arranging the combination of liquid, the structure of liquid flow path, and resistive material. FIG. 15B shows the example thereof. As the material for the resistance layer that does not require such protection layer, an alloy of iridium-tantalum-aluminum or the like may be cited.

Then, for the structure of heat generating elements adopted for each of the embodiments described above, it may be possible to provide only resistance layer (heat generating layer) between the electrodes or to include the protection layer to protect the resistance layer.

For the present embodiment, heat generating elements are used, each having heat generating unit structured by the resistive layer that generates heat in response to electric signals. However, the present invention is not limited to the use of such heat generating elements. It should be good enough if only each of the heat generating elements is capable of creating air bubbles in liquid sufficiently so as to enable liquid to be discharged. For example, the optothermal transducing elements whose heat generating unit generates heat when receiving laser beam or other light or some other heat generating elements provided with heat generating unit that generates heat when receiving high frequency.

Here, for the elemental substrate 1 described above, it may be possible to incorporate transistors, diodes, latches, shift registers and other functional elements integrally in the semiconductor manufacturing process, besides the resistance layer 105 constituting the heat generating unit and the electrothermal transducing elements structured by the wire electrodes that supply electric signals to the resistive layer, in order to selectively drive the electrothermal transducing elements.

Also, in order to drive each heat generating unit of the electrothermal transducing elements arranged for the elemental substrate described above for discharging liquid, rectangular pulses are applied to the resistance layer 105 through the wire electrodes 104, thus causing the resistive layer between the wire electrodes to generate heat abruptly. For each head of the previous embodiments, electric signals are applied at 6 kHz to drive each of the heat generating element at the voltage of 24 V, with pulse width of 7 $\mu$sec, and current of 150 mA. With such operation, ink liquid is discharged from each of the discharge ports. However, the condition of the driving signals is not necessarily limited to the one described above. It should be good enough if only driving signals are such as to enable bubbling liquid to foam appropriately.

(Structure of Head Having Two-Flow Path Structure)

Now, the description will be made of the structural example of a liquid jet head as given below, for which different liquids can be supplied to the first and second common liquid chambers separately in good condition, and with which it is possible to attempt reducing part numbers for the implementation of cost reduction.

Figure 17:
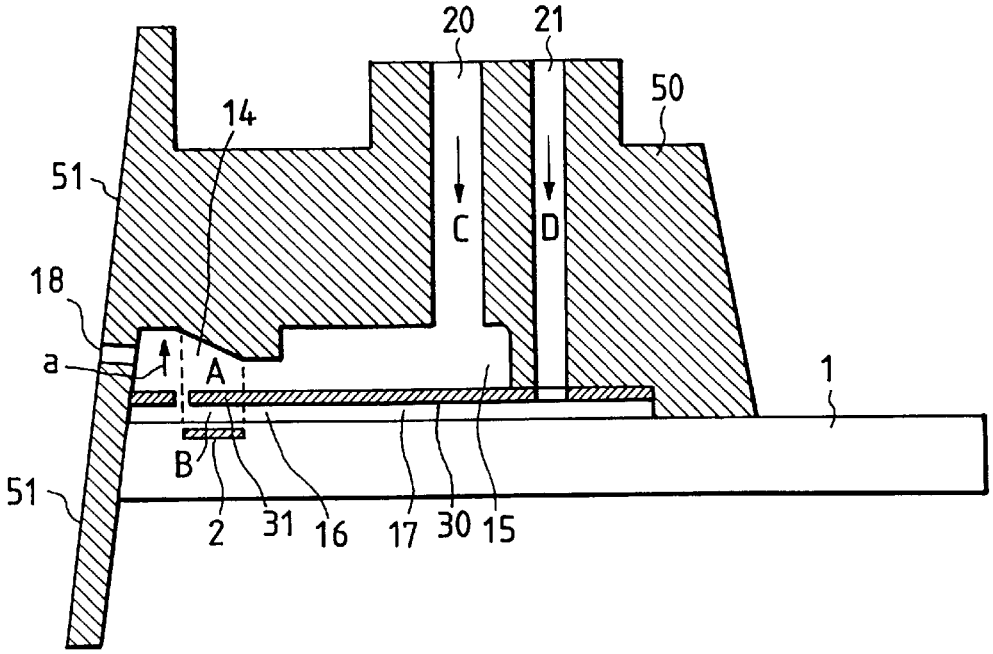
FIG. 17 is a cross-sectional view which illustrates the supply paths of a liquid jet head in accordance with the present invention.
Figure 18:
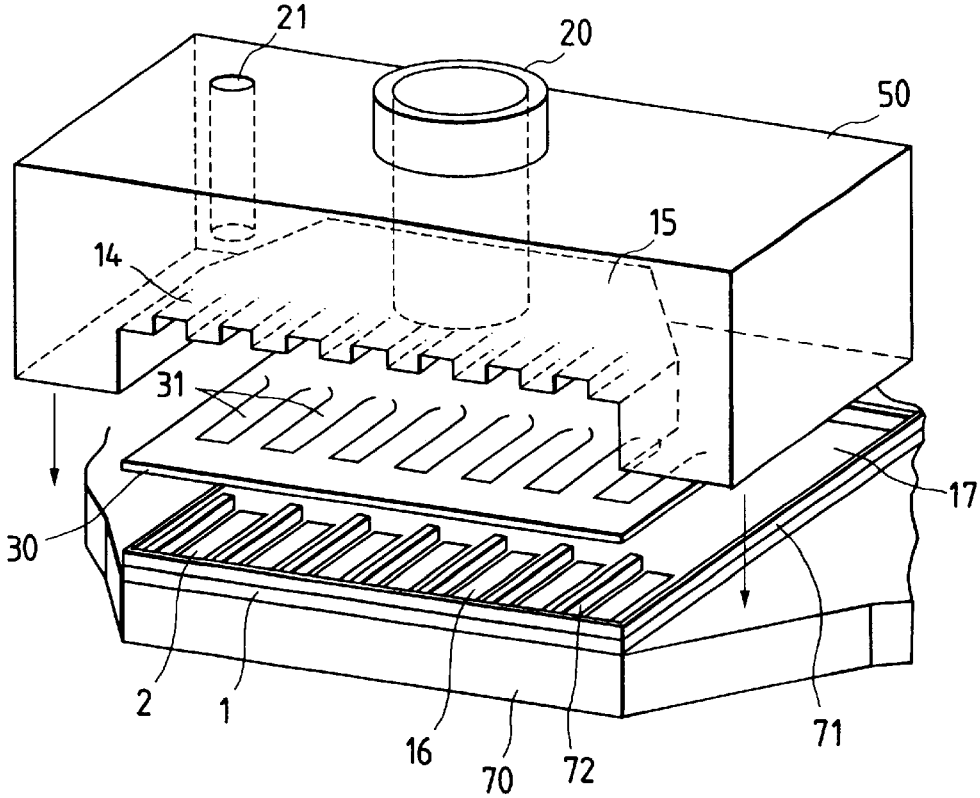
FIG. 18 is an exploded perspective view which shows a liquid jet head in accordance with the present invention.

FIG. 17 is a view which schematically illustrates the structure of a liquid jet head of the kind. Here, the same reference marks are used for the same constituents as in the previous embodiment, and the detailed description thereof will be omitted.

For the present embodiment, the grooved member 50 comprises an orifice plate 51 having discharging ports 18; a plurality of grooves constituting a plurality of first liquid flow paths 14; and a recessed portion to form a first common liquid chamber 15 to supply liquid (discharging liquid) to each of the first liquid flow paths 14.

A separation wall 30 is adhesively bonded to the lower side portion of the grooved member 50 to form a plurality of first liquid flow paths 14. The grooved member 50 is provided with the first liquid supply path 20 that reaches the interior of the first common liquid chamber 15 from the upper part of the grooved member. Also, the grooved member 50 is provided with the second liquid supply path 21 that reaches the interior of the second common liquid chamber from the upper part of the grooved member through the separation wall 30.

The first liquid (discharging liquid) is supplied to the first common liquid chamber 15 through the first liquid supply path 20 as indicated by an arrow C in FIG. 17, and then, supplied to the first liquid flow path 14. The second liquid (bubbling liquid) is supplied to the second common liquid chamber 17 through the second liquid supply path 21 as indicated by an arrow D in FIG. 17, and then, supplied to the second liquid flow path 16.

For the present embodiment, the second liquid supply path 21 is arranged in parallel with the first liquid supply path 20, but the arrangement is not necessarily limited to this structure. The arrangement can be made in any way if only the second liquid supply path is conductively connected with the second common liquid chamber 17 through the separation wall 30 arranged on the outer side of the first common liquid chamber 15.

Also, the thickness (diameter) of the second liquid supply path 21 may be determined in consideration of the supply amount of the second liquid. There is no need for the second liquid supply path 21 to be configured to circle. It may be configured in rectangle or the like.

Also, the second common liquid chamber 17 may be formed by partitioning the grooved member 50 by means of the separation wall 30. For the method of formation assembling, the frame of the common liquid chamber and the wall of the second liquid flow path are formed by dry film on the elemental substrate, and then, the second common liquid chamber 17 and the second liquid flow path 16 may be formed by adhesively bonding the elemental substrate 1, and the bonded element of the grooved member 50, and the separation wall 30 fixed to the grooved member together.

For the present embodiment, the elemental substrate 1, having a plurality of electrothermal transducing elements arranged therefor as heat generating elements to generate heat for the creation of air bubbles exerted by film boiling in bubbling liquid, is arranged on a supporting element 70 formed by aluminum or the other metal as described above.

On the elemental substrate 1, there are arranged a plurality of grooves to constitute the liquid flow path 16 formed by the wall of the second liquid flow path, a recessed portion to constitute the second common liquid chamber (common bubbling liquid chamber) 17 conductively connected with a plurality of bubbling liquid flow paths to supply bubbling liquid to each of them, and the separation wall 30 having the movable member 31 described earlier.

The grooved member 50 is provided with a groove to constitute the discharge liquid flow path (first liquid flow path) 14 when adhesively bonded to the separation wall 30; a recessed portion to constitute the first common liquid chamber (common discharging liquid chamber) 15 to supply discharging liquid to each of the discharging liquid flow paths; the first supply path (discharging liquid supply path) 20 to supply discharging liquid to the first common liquid chamber; and the second supply path (bubbling liquid supply path) 21 to supply bubbling liquid to the second common liquid chamber 17. The second common liquid chamber 21 is connected to the communication path conductively connected with the second common liquid chamber 17 through the separation wall 30 arranged on the outer side of the first common liquid chamber 15. By means of this communication path, bubbling liquid is supplied to the second common liquid chamber 15 without any mixture with discharging liquid.

In this respect, the positional relationship between the elemental substrate 1, separation wall 30, and grooved ceiling plate 50 is such that the movable member 31 can be arranged corresponding to the heat generating elements on the elemental substrate 1, and that the discharging liquid flow paths 14 are arranged corresponding to the movable member 31. Also, for the present embodiment, an example is shown in which one second supply path is arranged for the grooved member, but depending on the amount of supply, a plurality thereof may be arranged therefor. Further, the sectional areas for flow paths of the discharging liquid supply path 20 and bubbling liquid supply path 21 may be determined in proportion to the respective supply amounts.

Here, by optimizing the sectional areas of such flow paths, it becomes possible to make the components that constitute the grooved member smaller still.

In accordance with the present embodiment described above, it is possible to reduce the numbers of parts by arranging the grooved ceiling plate to function as one and the same member for the second liquid supply path to supply second liquid to the second flow path and the first liquid supply path to supply first liquid to the first liquid flow path, and then, to curtail the number of processes for attaining the reduction of costs.

Also, since the structure is arranged so that the supply of second liquid to the second common liquid chamber, which is conductively connected with the second liquid flow path, is performed by means of the second liquid flow path in the direction penetrating the separation wall that separate the first liquid and the second liquid, it is possible to adhesively bond the separation wall, grooved member, and substrate for the formation of heat generating elements together by the adoption of only one-time process. Therefore, the fabrication is made easier, while enhancing the precision of adhesive bonding, thus leading to discharging liquid in good condition.

Also, since the second liquid is supplied to the second common liquid chamber via penetration of the separation wall, the second liquid is supplied to the second flow path reliably, thus making it possible to secure a sufficient amount of supply for the stabilized discharging.

(Discharging Liquid and Bubbling Liquid)

In accordance with the present invention described in accordance with the previous embodiment, it is possible to discharge liquid with higher discharging power and discharging efficiency than the conventional liquid jet head by the adoption of the structure provided with the movable member described earlier. The speed of liquid discharge is also made higher. When the same liquid is used as bubbling liquid, and also, as discharging liquid for some of the structures embodying the present invention, it is possible to use various kinds of liquids if only the applying liquid is such that its quality is not deteriorated by the application of heat; it does not generate deposition easily on the heating elements when being heated; and it is capable of presenting reversible change of states by means of vaporization and condensation when being heated; and also, it does not cause each liquid flow path, movable member, and wall member to be deteriorated.

Of such liquids, it is possible to use ink having the composition used for the conventional bubble jet apparatus as liquid to be used for recording (recording liquid).

On the other hand, when different liquids are used as discharging liquid and bubbling liquid, respectively, by use of a head having the two-flow path structure of the present invention, it should be good enough to use liquid having the properties described above as bubbling liquid. More specifically, the following can be named: methanol, ethanol, n-propanol, isopropanol, n-hexan, n-heptane, n-octane, toluene, xylene, ethylene dichloride, trichloroethylene, Freon TF, Freon BF, ethyl ether, dioxane, cyclohexane, methyl acetate, ethyl acetate, acetone, methyl ether ketone, water, and its mixtures, among others.

As discharging liquid, various kinds of liquid can be used irrespective of the presence and absence of bubbling property and thermal characteristics. Also, even the liquid whose bubbling capability is low to make discharging difficult by use of the conventional head; the liquid whose properties are easily changeable or deteriorated when receiving heat; or the liquid whose viscosity is high; is usable as discharging liquid.

However, as the properties of discharging liquid, it is desirable that such liquid is the one that does not hinder discharging, bubbling, and the operation of the movable member or the like by the discharging liquid itself or by reaction caused by its contact with bubbling liquid.

As discharging liquid for recording, it is possible to use highly viscous ink or the like. As other discharging liquids, it may be possible to cite the use of such liquid as the medicine and perfume whose properties are not strong against heat.

For the present invention, recording is performed using ink having the following composition as a recording liquid capable of being used as both discharging liquid and bubbling liquid; here, with the enhanced discharging power, the discharging speed of ink becomes high, making it possible to obtain recorded image of extremely high quality brought about by the enhanced impact accuracy of droplets:

| Dye ink having a viscosity of 2 cp: | |
|---|---|
| (C.I food black 2) dye | 3 wt % |
| diethylene glycol | 10 wt % |
| thiodiglycol | 5 wt % |
| ethanol | 3 wt % |
| water | 77 wt % |

Also, recording is performed by combining liquid of having the following composition with bubbling liquid and discharging liquid; here, as a result, it becomes possible to discharge liquid having a high viscosity of 150 cp, not to mention the one having that of ten and several cp, all in such good condition that the conventional head cannot effectuate easily, and to obtain recorded images of high quality:

| | |
|---|---|
| Bubbling liquid 1: | |
| ethanol | 40 wt % |
| water | 60 wt % |
| Bubbling liquid 2: | |
| water | 100 wt % |
| Bubbling liquid 3: | |
| isopropyl alcohol | 10 wt % |
| water | 90 wt % |
| Discharge liquid 1; pigment ink (viscosity approximately 15 cp): | |
| carbon black | 5 wt % |
| styrene-acrylic acid-ethyl acrylate copolymer (acid value 140, weight average molecular weight 8,000) | 1 wt % |
| monoethanol amine | 0.25 wt % |
| glycerine | 69 wt % |
| thiodiglycol | 5 wt % |
| ethanol | 3 wt % |
| water | 16.75 wt % |
| Discharge liquid 2 (viscosity 55 cp): | |
| polyethylene glycol 200 | 100 wt % |
| Discharge liquid 3 (viscosity 150 cp): | |
| polyethylene glycol 600 | 100 wt % |

Now, when using the liquid which cannot be discharged easily by means of the conventional discharging described above, the variation of discharging orientation is promoted because of slower discharging speeds. As a result, the impact accuracy of dots on a recording sheet becomes unfavorable, making it difficult to obtain images of high quality. However, with the embodiments structured described above, the air bubbles can be created sufficiently and stably by use of bubbling liquid. Consequently, it is possible to enhance the impact accuracy of droplets and stabilize the discharging amount of ink, hence leading to the significant enhancement of the quality of recorded images.

(Structure of Head Cartridge)

Now, the brief description will be made of the liquid jet head cartridge that mounts a liquid jet head produced in accordance with the present invention described above.

Figure 19:
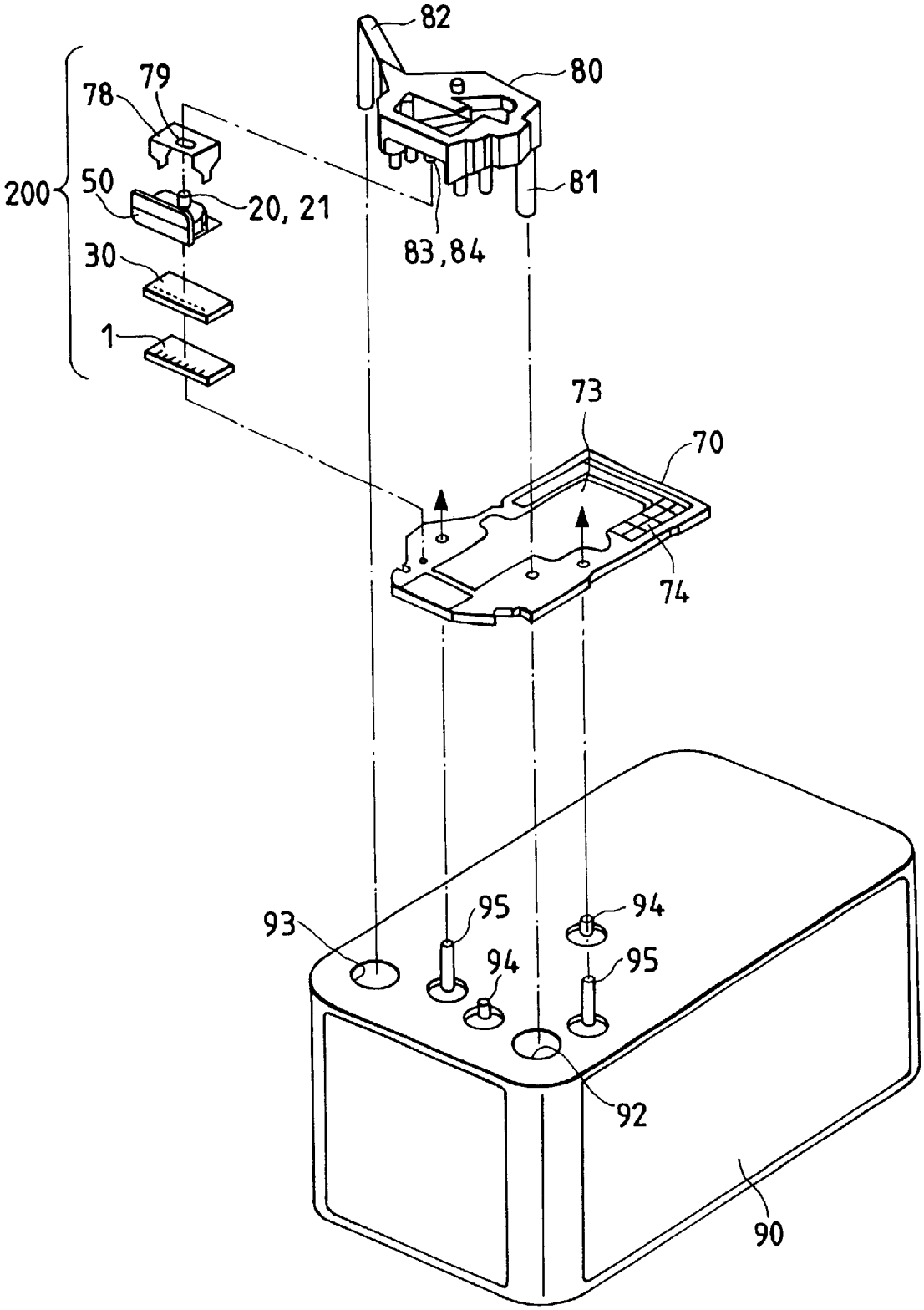
FIG. 19 is an exploded perspective view which schematically shows one embodiment of a liquid jet head cartridge in accordance with the present invention.

FIG. 19 is an exploded perspective view which schematically shows a liquid jet head cartridge. The liquid jet head cartridge is structured mainly by the liquid jet head unit 200 and the liquid container 90.

The liquid jet head unit 200 comprises the elemental substrate 1, the separation wall 30, the grooved member 50, the pressure spring 78, the liquid supply member 80, and the supporting element 70.

A plurality of heat generating resistors (heat generating elements) are arranged in line on the elemental substrate 1. Also, a plurality of functional elements are arranged to selectively drive these heat generating resistors. Each of the bubbling liquid flow paths is formed between the elemental substrate 1 and the separation wall 30 having movable member arranged therefor. Bubbling liquid is distributed in each of the flow paths. The separation wall 30 and the grooved ceiling plate 50 are adhesively bonded to form the liquid flow path (not shown) in order to distribute the discharging liquid for discharging.

The pressure spring 78 is a member that exerts biasing force on the grooved member 50 in the direction of the elemental substrate 1. By the application of this biasing force, the elemental substrate 1, the separation wall 30, the grooved member 50, and the supporting element 70 (to be described later) are put together in good condition.

The supporting element 70 is a member to support the elemental substrate 1 and others. On the supporting element 70, there are arranged the printed-wiring board 73, which is connected with the elemental substrate 1 to supply electric signals, and also, the contact pads 74, which are connected with the apparatus side to exchange electric signals with it.

The liquid container 90 retains ink or other discharging liquid, and bubbling liquid to create air bubbles in it. On the outer side of the liquid container, there are arranged a positioning unit 94 to connect the liquid jet head 200 and the liquid container 90, and a fixed shaft 95 for fixing them. Discharging liquid is supplied through a supply path 84 of the connecting member from the discharge liquid supply path 92 of the liquid container 90 to the discharging liquid supply path 81 of the liquid supply member 80, and then, supplied to the first common liquid chamber through each of the discharging liquid supply ports 83, 79, and 20 of each member, respectively. Likewise, bubbling liquid is supplied from the bubbling liquid supply path 93 of the liquid container 90 to the bubbling liquid supply path 82 of the liquid supply member 80 through the supply path of the connecting member, and then, supplied to the second liquid chamber through each of the bubbling liquid supply ports 84, 79, and 21.

Now, the description has been made of the liquid jet head cartridge having the supply mode that enables bubbling liquid and discharging liquid to be supplied as different liquids, and the liquid container 90 as well. However, when the discharging liquid and bubbling liquid are the same, the supply path for bubbling liquid and that for discharging liquid, and the container are not necessarily separated.

In this respect, the liquid container 90 may be used by refilling liquid after each liquid has been consumed. To this end, it is desirable to arrange a liquid injection port for the liquid container 90. Also, it may be possible to form the liquid jet head 200 and liquid container 90 integrally or to form them separately.

(Liquid Jet Head Industrial Apparatus•Ink Jet Recording System)

Now, description will be made of one example of ink jet recording system that uses the liquid jet head of the present invention as its recording head to perform recording on a recording medium.

Figure 20:
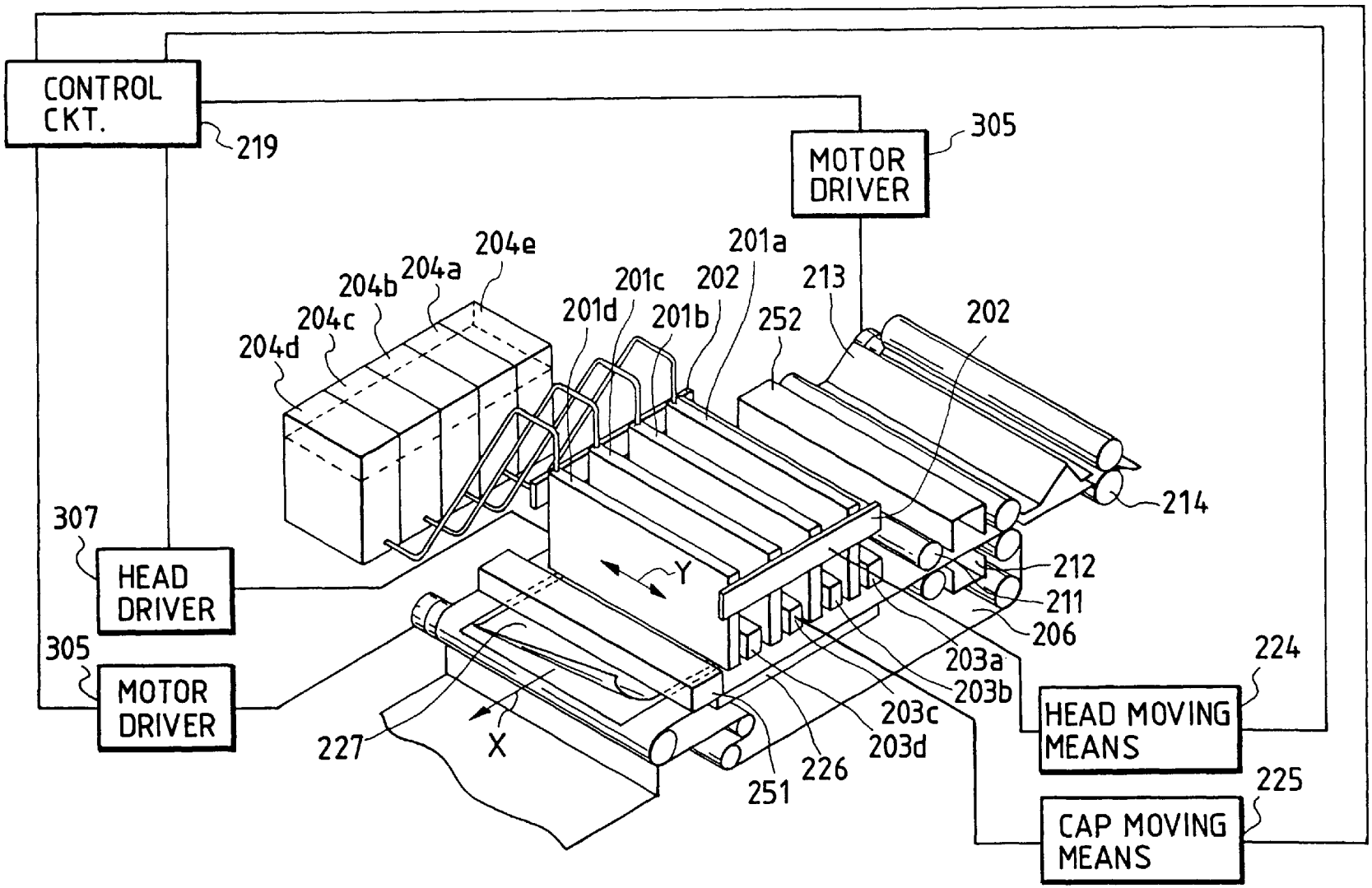
FIG. 20 is a perspective view which schematically shows one example of an ink jet recording system that performs recording in accordance with one embodiment of the liquid jet apparatus of the present invention.

FIG. 20 is a view which schematically illustrates the structure of this ink jet recoridng system using the liquid jet head of the present invention described above.

The liquid jet head of the present embodiment is a full line type head where a plurality of discharge ports are arranged in the length that corresponds to the recordable width of a recording medium 150 at intervals (density) of 360 dpi. Four liquid jet heads 201*a* to 201*d* are fixedly supported by the holder 202 in parallel to each other at given intervals in the direction X corresponding to four colors, yellow (Y), magenta (M), cyan (C), and black (Bk), respectively.

From the head driver 307 that forms driving signal supplying means, signals are supplied to each of the liquid jet heads. In accordance with such signals, each of the heads is driven.

To each of the heads, four different color ink, Y, M, C, Bk, are supplied from the ink containers 204*a* to 204*d* as discharging liquid, respectively. Here, a reference numeral 204*e* designates the bubbling liquid container that retains bubbling liquid. The structure is arranged so that bubbling liquid in the bubbling liquid container 204*e* are supplied to each of the liquid jet heads.

Also, below each of the liquid jet heads, head caps 203*a* to 203*d* are arranged with sponge or other ink absorbing material contained in them, and to cover the discharge ports of the liquid jet heads in order to maintain each of them when recording operation is at rest.

Here, a reference numeral 206 designates a carrier belt, which is arranged to constitute carrier means for carrying each kind of recording media as described earlier for each of the embodiments. This carrier belt 206 is drawn around various rollers at given passage and driven by driving rollers connected with the motor driver 305.

Also, for the ink jet recording system of the present embodiment, a pre-processing device 251, and post-processing device 252 are installed on the upstream and downstream of the recording medium carrier passage to perform various processes, respectively, with respect to the recording medium before and after recording.

The pre-processing and post-processing are different in the contents of the corresponding process depending on the kinds of recording media and kinds of ink. For example, with respect to recording on a medium such as metal, plastic, or ceramic, ultraviolet rays and ozone are irradiated to activate the surface of the medium used, thus improving the adhesion of ink thereto. Also, when recording on a medium, such as plastic, that easily generates static electricity, dust particles are easily attracted to the surface thereof to hinder good recording in some cases. Therefore, as the pre-processing device, an ionizer is used to remove static electricity. In this way, dust particles should be removed from the recording medium. Also, when cloths are used as a recording medium, a pre-processing may be performed to provide a substance selected from among alkali substance, water-soluble substance, synthetic polymer, water-soluble metallic salt, urea, and thiourea for recording on cloths in order to prevent stains on them, while improving its coloring rate. However, the pre-processing is not necessarily limited to those described above. It may be the process to adjust the temperature of a recording medium appropriately to a temperature suited for recording on such medium.

On the other hand, for the present embodiment, the description has been made of a full line head adopted for use as the liquid jet head, but the present invention is not necessarily limited to it. It may be possible to apply the present invention to such a mode as to enable the smaller liquid jet head described earlier to operate in the width direction of a recording medium for recording.

Further, the embodiment described above presents the most rational structure for the displacement of the movable member corresponding to the pressure exerted when each of the air bubbles is created. It may be possible for the present invention to arrange a structure so that the movable member is caused to move by use of some other means for enabling it to be displaced slightly or the movable member is caused to move by means of the pressure waves at the time of bubbling, while being moved by such means preceding it. As another means adoptable here, there are many means that may be utilized for displacing the movable member, such as means for driving the bimetal that forms a movable member.

Since the present invention is provided with the structural conditions described above, it is possible to make the initiation of the displacement of the free end of the movable member quickly and reliably, and to lead the pressure to the discharge port side and the fulcrum side of the movable member sufficiently at the time of bubbling. Consequently, the development of each air bubble that follows is directed to the discharge port side more reliably and efficiently.

What is claimed is:

1. A liquid discharging head comprising:

an electrothermal converting element for generating thermal energy to be used for discharging a liquid from a discharge port and forming an effective bubbling region for generating a bubble; and a moveable member provided opposite to said electrothermal converting element and having a free end extending toward said discharge port, said moveable member also having a fulcrum located further from said discharge port than said free end, said moveable member dividing a liquid flow path above said electrothermal converting element into first and second liquid flow paths, said first liquid flow path being conductively connected to said discharge port and the second liquid flow path being provided with said electrothermal converting element, said free end of said moveable member being provided opposite to said electrothermal converting element on a downstream side of a center of said effective bubbling region with respect to a direction toward said discharge port and on an upstream side of the end of said effective bubbling region nearest said discharge port, and a heat generating surface of said electrothermal converting element being substantially flush with or smoothly continuous with an upstream surface adjacent said heat generating surface.

2. A liquid discharging head according to claim 1 wherein, the fulcrum of said moveable member is positioned on a side different from said discharge port with respect to the displacement area through which said free end of said moveable member moves, said free end being arranged to face the effective bubbling region positioned on the downstream side of the central portion of the length of the effective bubbling region forming said air bubble generating area in the direction of said moveable member from the fulcrum to the free end thereof, and a part of said effective bubbling region, which is positioned to face said free end on the downstream side of said effective bubbling region, being arranged to face said displacement area directly.

3. A liquid discharging head according to claim 2, wherein said part of the effective bubbling region faces the displacement area directly and is arranged to include the most downstream side with respect to said effective bubbling region in said aforesaid direction.

4. A liquid discharging head according to claim 2, wherein said part of the effective bubbling region facing the displacement area directly is a range of 5 $\mu$m or more as the range with respect to said direction.

5. A liquid discharging head according to claim 2, wherein the inclination of pressure in the vicinity of said displacement area of the free end of said movable member is intensified by means of a structure for reflecting or inducing the acoustic waves generated at the time of bubbling in said effective bubbling region.

6. A liquid discharging head according to claim 2, wherein said air bubbles are created by means of film boiling phenomenon in said effective bubbling region of heat generating element.

7. A liquid discharging apparatus incorporating a liquid jet head according to claim 2, and further incorporating:

a structure for supplying liquid equally to said displacement area and said air bubble generating area.

8. A liquid discharging apparatus incorporating a liquid jet head according to claim 2, and further incorporating:

a first structure for supplying a first liquid to said displacement area; and a second structure for supplying a second liquid different from said first liquid to said air bubble generating area in state wherein said second liquid is separated from said first liquid.

9. A liquid jet apparatus incorporating a liquid discharging head according to claim 2, and further incorporating:

means for carrying a recording medium to a printing area to receive liquid discharged from the head; and driving means for providing driving condition for said electrothermal converting element.

10. A liquid discharging method for discharging liquid from a liquid discharging head which comprises:

an electrothermal converting element for generating thermal energy to be used for discharging a liquid from a discharge port and forming an effective bubbling region for generating a bubble, a heat generating surface of said electrothermal converting element being substantially flush with or smoothly continuous with an upstream surface adjacent said heat generating surface, and a moveable member provided opposite to said electrothermal converting element and having a free end extending toward said discharge port and a fulcrum located further from said discharge port than said free end, said moveable member dividing a liquid flow path above said electrothermal converting element into first and second liquid flow paths, said first liquid flow path being conductively connected to said discharge port and the second liquid flow path being provided with said electrothermal converting element;

said free end of said moveable member being provided opposite to said electrothermal converting element on a downstream side of a center of said effective bubbling region with respect to a direction toward said discharge port and on an upstream side of the end of said effective bubbling region nearest said discharge port, said method comprising the steps of:

operating said electrothermal converting element to generate thermal energy to form a bubble in liquid present in said head; and facilitating said movement of said free end by the transfer of acoustic waves generated by said bubble directly into a displacement region into which said free end moves.

11. A liquid discharging method according to claim 10, wherein said part of the effective bubbling region faces the displacement area directly and is arranged to include the most downstream side with respect to said effective bubbling region in said direction.

12. A liquid discharging method according to claim 10, wherein said part of the effective bubbling area facing the displacement region directly is a range of 5 $\mu$m or more as the range with respect to said direction.

13. A liquid discharging method according to claim 10, wherein the inclination of pressure in the vicinity of said displacement area of the free end of said movable member is intensified by means of a structure for reflecting or inducing the acoustic waves generated at the time of bubbling in said effective bubbling area.

14. A liquid discharging method according to claim 10, wherein said air bubbles are created by means of film boiling phenomenon in said effective bubbling area of heat generating element.

* * * * *

UNITED STATES PATENT AND TRADEMARK OFFICE

CERTIFICATE OF CORRECTION

PATENT NO. : 6,595,625 B2
DATED : July 22, 2003
INVENTOR(S) : Sadayuki Sugama et al.

It is certified that error appears in the above-identified patent and that said Letters Patent is hereby corrected as shown below:

Title page,
Item [56], References Cited, FOREIGN PATENT DOCUMENTS, insert:
-- JP 6-31918 2/1994 ….. --.

Column 1,
Line 31, “but only” should read -- but also --.
Line 51, “noises” should read -- noise --.

Column 2,
Line 48, “instabilzed” should read -- unstable --.

Column 3,
Line 5, “the” should read -- this --.
Line 64, “is” should read -- are --.

Column 10,
Line 17, “down stream” should read -- downstream --.

Column 13,
Line 43, “disperse” should read -- disperses --.
Line 49, “refiling” should read -- refilling --.

Column 15,
Line 21, “an” should read -- a --.

Column 17,
Line 23, “anyway” should read -- any way --.

Column 22,
Line 12, “it” should read -- is --.

Column 23,
Line 28, “element” should read -- elements --.

Column 24,
Line 15, “to” (second occurrence) should read -- as a --.

Column 25,
Line 20, “separate” should read -- separates --.

UNITED STATES PATENT AND TRADEMARK OFFICE

CERTIFICATE OF CORRECTION

PATENT NO. : 6,595,625 B2
DATED : July 22, 2003
INVENTOR(S) : Sadayuki Sugama et al.

It is certified that error appears in the above-identified patent and that said Letters Patent is hereby corrected as shown below:

Column 28,
Line 16, “recoriding system” should read -- recording system --.

Column 29,
Line 62, “claim 1 wherein,” should read -- claim 1, wherein --.

Column 30,
Lines 28 and 32, “jet” should read -- discharging --.

Column 31,
Line 6, “said” should read -- ¶ said --.
Line 13, “displacement region” should read -- displacement area --.

Column 32,
Lines 3 and 14, “bubbling area” should read -- bubbling region --.
Line 4, “displacement region” should read -- displacement area --.
Line 9, “displacement area” should read -- displacement region --; and “movable” should read -- moveable --.
Line 11, “bubbling area.” should read -- bubbling region. --.

Signed and Sealed this

Twenty-first Day of October, 2003

JAMES E. ROGAN
*Director of the United States Patent and Trademark Office*